US010831133B1

(12) United States Patent
Sugiura et al.

(10) Patent No.: US 10,831,133 B1
(45) Date of Patent: Nov. 10, 2020

(54) ENDLESS BELT, METHOD FOR PRODUCING THE ENDLESS BELT, TRANSFER DEVICE, AND IMAGE FORMING APPARATUS

(71) Applicant: FUJI XEROX CO., LTD., Tokyo (JP)

(72) Inventors: Satoya Sugiura, Kanagawa (JP); Shigeru Fukuda, Kanagawa (JP); Futoshi Takei, Kanagawa (JP); Daisuke Tanemura, Kanagawa (JP); Masato Ono, Kanagawa (JP); Masato Furukawa, Kanagawa (JP); Hiroaki Tanaka, Kanagawa (JP); Shogo Hayashi, Kanagawa (JP); Tomoko Suzuki, Kanagawa (JP); Masayuki Seko, Kanagawa (JP); Koichi Matsumoto, Kanagawa (JP); Minoru Rokutan, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/850,089

(22) Filed: Apr. 16, 2020

(30) Foreign Application Priority Data

Dec. 6, 2019 (JP) ..... 2019-221325

(51) Int. Cl.

| | |
|---|---|
| ***G03G 15/01*** | (2006.01) |
| ***G03G 15/16*** | (2006.01) |
| *G03G 15/20* | (2006.01) |

(52) U.S. Cl.
CPC ..... *G03G 15/1605* (2013.01); *G03G 15/162* (2013.01); *G03G 15/2053* (2013.01); *G03G 15/2057* (2013.01)

(58) Field of Classification Search
CPC ..... G03G 15/1605; G03G 15/162; G03G 15/2053; G03G 15/2057; G03G 5/071; G03G 5/075
See application file for complete search history.

(56) References Cited

U.S. PATENT DOCUMENTS 7,639,976 B2 12/2009 Yoshida
8,014,708 B2 9/2011 Sawai
(Continued)

FOREIGN PATENT DOCUMENTS

JP 2007-11117 A 1/2007
JP 2007-78789 A 3/2007
(Continued)

*Primary Examiner* — Hoang X Ngo
(74) *Attorney, Agent, or Firm* — Sughrue Mion, PLLC

(57) ABSTRACT

An endless belt includes a first resin and first conductive carbon particles. In the spatial distribution of the first conductive carbon particles present in an evaluation region of the outer peripheral surface of the endless belt which has a size of 6.3 μm×4.2 μm, the integral of the statistic L(r) represented by Formula (1) below from 0.05 μm to 0.30 μm with respect to an interparticle distance r is 0 or more and 0.1 or less, $$L(r):=\sqrt{K(r)/\pi}-r \tag{1}$$

where r represents an interparticle distance; and K(r) represents the Ripley's K function K(r) represented by Formula (2) below, $$K(r):=\frac{\sum_{i\neq j}^{N} 1(|X_i-X_j|\leq r)/s(|X_i-X_j|)}{\lambda^2} \tag{2}$$

where $1(|X_i-X_j|\leq r)$ represents an indicator function; $X_i$ and $X_j$ represent the coordinates of points i and j, respectively; $|X_i-X_j|$ represents the Euclidean distance between the coordinates $X_i$ and $X_j$; r represents the interparticle distance; $s(|X_i-X_j|)$ represents an edge correction factor s(x) in the evaluation region which is
(Continued)

represented by Formula (3) below, x being $|X_i - X_j|$; N represents the total number of particles present in the evaluation region; and λ represents the number density of the particles in the evaluation region, $$s(x) := L_x L_y - \frac{x}{\pi}(2L_x + 2L_y - x) \tag{3}$$

where $L_x$ and $L_y$ represent the lengths (μm) of the sides of the evaluation region which extend in the x axis and y axis directions, respectively; $x=|X_i - X_j|$; $X_i$ and $X_j$ represent the coordinates of points i and j, respectively; and $|X_i - X_j|$ represents the Euclidean distance between the coordinates $X_i$ and $X_j$.

20 Claims, 1 Drawing Sheet

(56) References Cited

U.S. PATENT DOCUMENTS

2011/0177238 A1* 7/2011 Aoto ..... G03G 15/16
427/152
2012/0082488 A1* 4/2012 Kubo ..... G03G 15/162
399/302

FOREIGN PATENT DOCUMENTS

JP 2009-139657 A 6/2009
JP 4772590 B2 9/2011

* cited by examiner

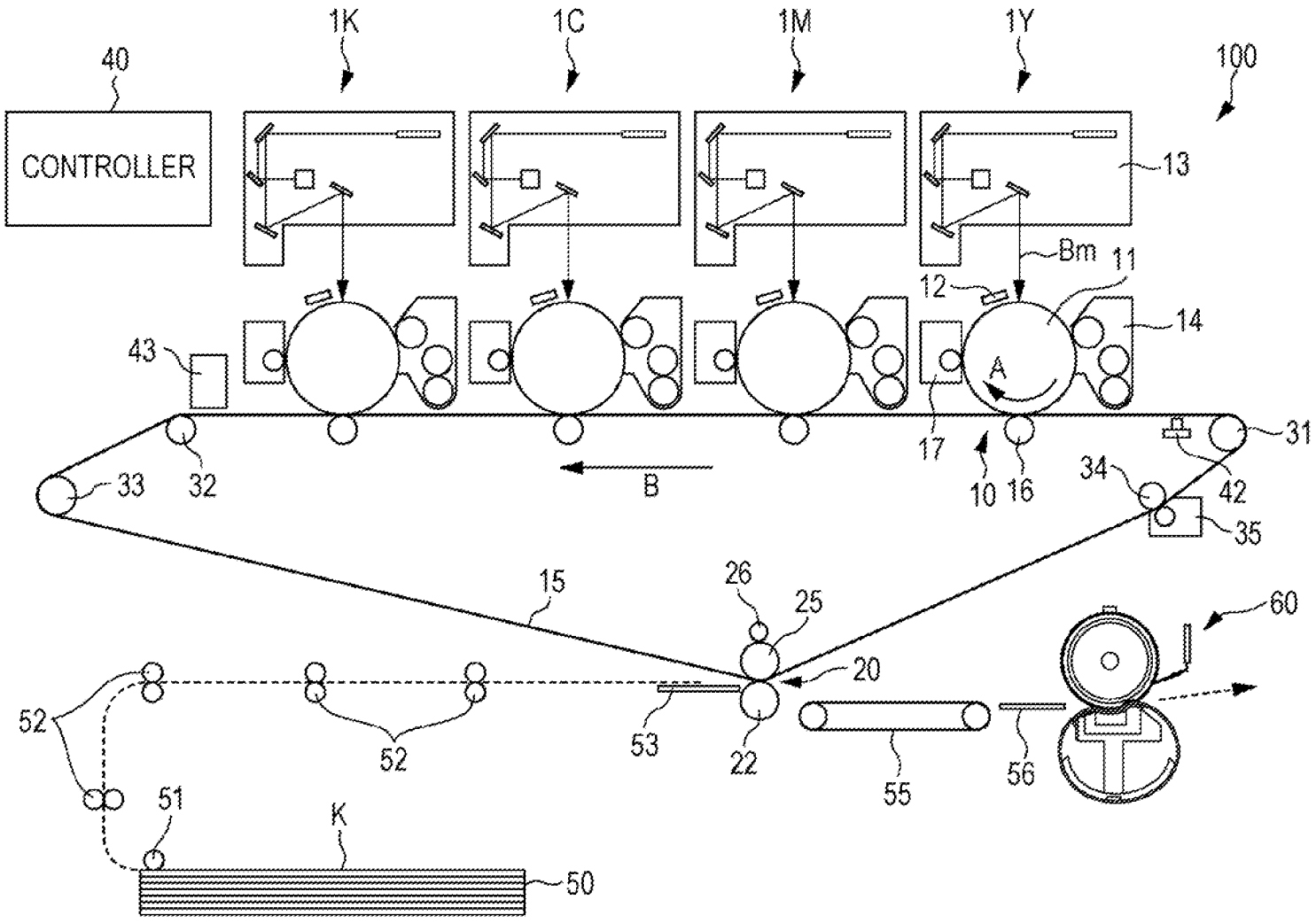
100
1Y
1M
1C
1K
13
14
11
Bm
12
A
16
10
17
31
42
35
34
60
56
55
20
25
26
22
53
B
15
50
52
K
51
52
32
33
43
40
CONTROLLER

ENDLESS BELT, METHOD FOR PRODUCING THE ENDLESS BELT, TRANSFER DEVICE, AND IMAGE FORMING APPARATUS

CROSS-REFERENCE TO RELATED APPLICATIONS

This application is based on and claims priority under 35 USC 119 from Japanese Patent Application No. 2019-221325 filed Dec. 6, 2019.

BACKGROUND

(i) Technical Field

The present disclosure relates to an endless belt, a method for producing the endless belt, a transfer device, and an image forming apparatus.

(ii) Related Art

Electrophotographic image forming apparatuses (e.g., a copying machine, a facsimile, and a printer) form an image by transferring a toner image formed on the surface of an image holding member onto the surface of a recording medium and fixing the toner image to the recording medium. When a toner image is transferred to a recording medium, for example, an electrically conductive endless belt, such as an intermediate transfer belt, is used.

For example, Japanese Laid Open Patent Application Publication No. 2007-011117 discloses an intermediate transfer belt that includes a substrate and at least a surface layer disposed on the substrate, the surface layer including aggregates of conductive particles having an average size of 0.5 to 25 μm.

Japanese Laid Open Patent Application Publication No. 2007-078789 discloses an intermediate transfer belt that includes a substrate and at least a surface layer disposed on the substrate, the surface layer including resin microparticles coated with a metal.

SUMMARY

In the case where a recording medium having large surface irregularities (hereinafter, such a recording medium is referred to as "rough surface paper"), such as embossed paper, is used in an image forming apparatus that includes an endless belt as an intermediate transfer body, the intermediate transfer body may fail to follow the rough surface of the recording medium when a toner image is transferred from the intermediate transfer body to the recording medium. This reduces transferability and may cause white missing dots to be formed in an image.

Aspects of non-limiting embodiments of the present disclosure relate to an endless belt that may enhance the transferability to rough surface paper when used as an intermediate transfer body, compared with an endless belt that includes the first resin and the first conductive carbon particles, wherein the integral of the statistic L(r) is more than 0.1.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an endless belt including a first resin and first conductive carbon particles. In a spatial distribution of the first conductive carbon particles present in an evaluation region of an outer peripheral surface of the endless belt, the evaluation region having a size of 6.3 μm×4.2 μm, an integral of a statistic L(r) represented by Formula (1) below from 0.05 μm to 0.30 μm with respect to an interparticle distance r is 0 or more and 0.1 or less, $$L(r) := \sqrt{K(r)/\pi} - r \tag{1}$$

where r represents the interparticle distance; and K(r) represents a Ripley's K function K(r) represented by Formula (2) below, $$K(r) := \frac{\sum_{i \neq j}^{N} 1(|X_i - X_j| \leq r)/s(|X_i - X_j|)}{\lambda^2} \tag{2}$$

where $1(|X_i - X_j| \leq r)$ represents an indicator function; $X_i$ and $X_j$ represent coordinates of points i and j, respectively; $|X_i - X_j|$ represents an Euclidean distance between the coordinates $X_i$ and $X_j$; r represents the interparticle distance; $s(|X_i - X_j|)$ represents an edge correction factor s(x) in the evaluation region, the edge correction factor s(x) being represented by Formula (3) below, x being $|X_i - X_j|$; N represents a total number of particles present in the evaluation region; and λ represents a number density of the particles in the evaluation region, $$s(x) := L_x L_y - \frac{x}{\pi}(2L_x + 2L_y - x) \tag{3}$$

where $L_x$ and $L_y$ represent the lengths (μm) of sides of the evaluation region which extend in x axis and y axis directions, respectively; $x = |X_i - X_j|$; $X_i$ and $X_j$ represent coordinates of points i and j, respectively; and $|X_i - X_j|$ represents a Euclidean distance between the coordinates $X_i$ and $X_j$.

BRIEF DESCRIPTION OF THE DRAWINGS

An exemplary embodiment of the present disclosure will be described in detail based on the following FIGURE, wherein:

FIGURE is a schematic diagram illustrating an example of an image forming apparatus according to an exemplary embodiment.

DETAILED DESCRIPTION

An exemplary embodiment is described below. The following description and Examples below are intended to be illustrative of the exemplary embodiment and not restrictive of the scope of the exemplary embodiment.

In the exemplary embodiment, when numerical ranges are described in a stepwise manner, the upper or lower limit of a numerical range may be replaced with the upper or lower limit of another numerical range, respectively. In the exemplary embodiment, the upper and lower limits of a numerical range may be replaced with the upper and lower limits described in Examples below.

The term "step" used herein refers not only to an individual step but also to a step that is not distinguishable from other steps but achieves the intended purpose of the step.

In the exemplary embodiment, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the exemplary embodiment may include plural types of substances that correspond to the component. In the exemplary embodiment, in the case where a composition includes plural substances that correspond to a component of the composition, the content of the component in the composition is the total content of the plural substances in the composition unless otherwise specified.

Endless Belt

An endless belt according to an exemplary embodiment includes a first resin and first conductive carbon particles. In the spatial distribution of the first conductive carbon particles present in an evaluation region of the outer peripheral surface of the endless belt which has a size of 6.3 μm×4.2 μm, the integral of the statistic L(r) represented by Formula (1) below from 0.05 μm to 0.30 μm with respect to an interparticle distance r is 0 or more and 0.1 or less.

$$L(r):=\sqrt{K(r)/\pi}-r \tag{1}$$

In Formula (1) above, r represents an interparticle distance; and K(r) represents the Ripley's K function K(r) represented by Formula (2) below.

$$K(r):=\frac{\sum_{i\neq j}^{N} 1(|X_i-X_j|\leq r)/s(|X_i-X_j|)}{\lambda^2} \tag{2}$$

In Formula (2) above, $1(|X_i-X_j|\leq r)$ represents an indicator function; $X_i$ and $X_j$ represent the coordinates of points i and j, respectively; represents the Euclidean distance between the coordinates $X_i$ and $X_j$; r represents an interparticle distance; $s(|X_i-X_j|)$ represents an edge correction factor s(x) in the evaluation region which is represented by Formula (3) below, x being $|X_i-X_j|$; N represents the total number of particles present in the evaluation region; and λ represents the number density of the particles in the evaluation region.

$$s(x):=L_xL_y-\frac{x}{\pi}(2L_x+2L_y-x) \tag{3}$$

In Formula (3) above, $L_x$ and $L_y$ represent the lengths (μm) of the sides of the evaluation region which extend in the x axis and y axis directions, respectively; $x=|X_i-X_j|$; $X_i$ and $X_j$ represent the coordinates of points i and j, respectively; and represents the Euclidean distance between the coordinates $X_i$ and $X_j$.

The spatial distribution of the conductive carbon particles is determined by observing the outer peripheral surface of the endless belt with a scanning electron microscope, such as "SU8010" produced by Hitachi High-Tech Corporation, at a 20,000-fold magnification and converting the resulting 256-level image into a binary representation with a threshold of 128 by using analysis software, such as "ImageJ" (freeware), as needed. A statistic L(r) is calculated using the above formulae in the range of 0.05 μm or more and 0.30 μm or less with respect to an interparticle distance r at intervals of 0.05 μm to obtain the integral of the statistic L(r) from 0.05 μm to 0.30 μm.

Hereinafter, the integral of the statistic L(r) represented by Formula (1) from 0.05 μm to 0.30 μm with respect to an interparticle distance r in the spatial distribution of the first conductive carbon particles present in an evaluation region of the outer peripheral surface of the endless belt which has a size of 6.3 μm×4.2 μm may be referred to simply as "L(r) integral".

Since the L(r) integral is 0 or more and 0.1 or less, the endless belt according to the exemplary embodiment may enhance the transferability to rough surface paper when used as an intermediate transfer body. The reasons are not clear but presumably as follows.

In the case where a rough surface paper sheet is used as a recording medium in an image forming apparatus that includes an endless belt as an intermediate transfer body, the intermediate transfer body may fail to follow the rough surface of the recording medium when a toner image is transferred from the intermediate transfer body to the recording medium. This reduces transferability and may cause white missing dots to be formed in an image. Specifically, for example, in the case where the electric field applied during the transfer of a toner image is increased in order to generate a sufficiently high transfer electric field in the recesses present in the recording medium, an excessively high electric field may be applied locally to the protrusions present in the recording medium. This results in occurrence of abnormal discharge. As a result, the amount of charge stored in the toner may be reduced, or the toner may be oppositely charged. This may degrade transferability.

The degradation of transferability may become severe particularly in a tandem image forming apparatus, in which a multicolor image produced by forming plural monochrome images on an intermediate transfer body in a superimposed manner is transferred from the intermediate transfer body to a recording medium, and more particularly in such a tandem image forming apparatus that includes toner particles having small particle sizes.

In contrast, in the endless belt according to the exemplary embodiment, the L(r) integral is 0 or more and 0.1 or less. That is, the conductive carbon particles are finely dispersed on the outer peripheral surface of the endless belt. Accordingly, even when the intermediate transfer body fails to follow the rough surface of a recording medium and an excessively high electric field is applied locally to the protrusions present in the rough surface paper, small discharge may occur at each of the conducting points finely dispersed on the outer peripheral surface of the endless belt and, consequently, the current may be dispersed. This may limit the reduction in the amount of charge stored in the toner or the likelihood of the toner becoming oppositely charged due to the abnormal discharge and enhance transferability.

The term "conductive" used herein refers to having a volume resistivity of less than $1\times10^{13}$ Ωcm at 20° C.

A method for adjusting the L(r) integral to fall within the above range is not limited. Examples of the method include a method in which carbon particles having a small number average primary particle size are used as first conductive carbon particles; and a method in which the type of the first conductive carbon particles used is selected appropriately; and a method in which the conditions under which the endless belt is produced (e.g., drying conditions) are adjusted appropriately.

The L(r) integral is preferably 0 or more and 0.08 or less and is more preferably 0 or more and 0.06 or less in order to enhance the transferability to rough surface paper.

The endless belt may be either a single-layer body or a multilayer body.

In the case where the endless belt is a single-layer body, the single-layer body is the layer including the first resin and the first conductive carbon particles and having an L(r) integral of 0 or more and 0.1 or less.

In the case where the endless belt is a multilayer body, the multilayer body includes, for example, a substrate layer and a surface layer disposed on the substrate layer. The surface layer is the outermost layer of the endless belt. The multilayer body may include another layer interposed between the substrate layer and the surface layer.

In the case where the endless belt is the multilayer body including the substrate layer and the surface layer, the surface layer is the layer including the first resin and the first conductive carbon particles and having an L(r) integral of 0 or more and 0.1 or less. The substrate layer is not limited. The substrate layer is, for example, a layer including a second resin and second conductive carbon particles.

Hereinafter, the layer constituting the endless belt that is the single-layer body may be referred to as "single layer"; the surface layer constituting the endless belt that is the multilayer body, which includes the first resin and the first conductive carbon particles, may be referred to as "first layer"; and the substrate layer constituting the endless belt that is the multilayer body, which includes the second resin and the second conductive carbon particles, may be referred to as "second layer".

Resin

Examples of the first resin included in the single layer or the first layer include a polyimide (PI) resin; a polyamide imide (PAI) resin; an aromatic polyetherketone resin, such as an aromatic polyether ether ketone resin; a polyphenylene sulfide (PPS) resin, a polyetherimide (PEI) resin; a polyester resin; a polyamide resin; and a polycarbonate resin. In order to increase mechanical strength and enhance the dispersibility of the first conductive carbon particles, the first resin preferably includes at least one selected from the group consisting of a polyimide resin, a polyamide imide resin, an aromatic polyether ether ketone resin, a polyetherimide resin, and a polyphenylene sulfide resin, and more preferably includes at least one selected from the group consisting of a polyimide resin and a polyamide imide resin. Among the above resins, a polyimide resin is further preferable in consideration of mechanical strength. The first resin may be either only one type of resin or a mixture of two or more types of resins.

Specific examples of the second resin included in the second layer are the same as the above-described specific examples of the first resin. The second resin may be either only one type of resin or a mixture of two or more types of resins.

In the case where the endless belt includes the first and second layers, the types of the first and second resins may be the same as or different from each other. For example, the first and second resins may be a polyimide resin.

Polyimide Resin

The polyimide resin may be, for example, a polyimide resin produced by imidization of a polyamic acid (i.e., precursor of the polyimide resin) produced by polymerization of a tetracarboxylic dianhydride with a diamine.

Examples of the polyimide resin include a resin including the structural unit represented by General Formula (I) below.

(I)

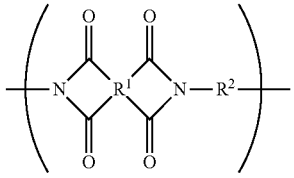

In General Formula (I), $R^1$ represents a tetravalent organic group, and $R^2$ includes a divalent organic group.

Examples of the tetravalent organic group represented by $R^1$ include an aromatic group, an aliphatic group, a cyclic aliphatic group, a group including an aromatic group and an aliphatic group, and the above groups that include a substituent. Specific examples of the tetravalent organic group include a residue of the tetracarboxylic dianhydride described below.

Examples of the divalent organic group represented by $R^2$ include an aromatic group, an aliphatic group, a cyclic aliphatic group, a group including an aromatic group and an aliphatic group, and the above groups that include a substituent. Specific examples of the divalent organic group include a residue of the diamine described below.

Specific examples of the tetracarboxylic dianhydride used as a raw material for the polyimide resin include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine used as a raw material for the polyimide resin include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-tert-butyl)toluene, bis(p-β-amino-tert-butylphenyl)ether, bis(p-β-methyl-δ-aminophenyl)benzene, bis-p-(1,1-dimethyl-5-amino-pentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminoprpoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

Polyamide Imide Resin

Examples of the polyamide imide resin include a resin having a repeating unit including an imide linkage and an amide linkage.

Specific examples of the polyamide imide resin include a polymer formed by polymerization of a trivalent carboxylic acid (i.e., tricarboxylic acid) including an acid anhydride group with a diisocyanate or a diamine.

Examples of the tricarboxylic acid include trimellitic anhydride and derivatives thereof. The tricarboxylic acid may be used in combination with a tetracarboxylic dianhydride, an aliphatic dicarboxylic acid, an aromatic dicarboxylic acid, or the like.

Examples of the diisocyanate include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine include a compound that has a structure analogous to that of the above-described isocyanate and includes amino groups instead of isocyanato groups.

Aromatic Polyetherketone Resin

Examples of the aromatic polyetherketone resin include a resin that includes aromatic rings, such as benzene rings, bonded to one another through ether and ketone linkages in a linear manner.

Examples of the aromatic polyetherketone resin include polyetherketone (PEK) in which an ether linkage and a ketone linkage are arranged alternately; polyether ether ketone (PEEK) in which an ether linkage, an ether linkage, and a ketone linkage are arranged in this order; polyetherketoneketone (PEKK) in which an ether linkage, a ketone linkage, and a ketone linkage are arranged in this order; polyether ether ketone ketone (PEEKK) in which an ether linkage, an ether linkage, a ketone linkage, and a ketone linkage are arranged in this order; and polyetherketone ester that includes an ester linkage.

The content of the first resin in the entire single layer is preferably 60% by mass or more and 95% by mass or less, is more preferably 70% by mass or more and 95% by mass or less, and is further preferably 75% by mass or more and 90% by mass or less in consideration of mechanical strength, the adjustment of volume resistivity, and the like.

The content of the first resin in the entire first layer is preferably 60% by mass or more and 95% by mass or less, is more preferably 70% by mass or more and 95% by mass or less, and is further preferably 75% by mass or more and 90% by mass or less in consideration of mechanical strength, the adjustment of volume resistivity, and the like.

The content of the second resin in the entire second layer is preferably 60% by mass or more and 95% by mass or less, is more preferably 70% by mass or more and 95% by mass or less, and is further preferably 75% by mass or more and 90% by mass or less in consideration of mechanical strength, the adjustment of volume resistivity, and the like.

Conductive Carbon Particles

Examples of the first conductive carbon particles included in the single layer or the first layer include particles of carbon black.

Examples of the carbon black include Ketjenblack, oil furnace black, channel black, and acetylene black. The carbon black particles may be carbon black particles the surfaces of which have been treated (hereinafter, such carbon black particles may be referred to as "surface treated carbon black particles").

The surface treated carbon black particles are produced by attaching a carboxyl group, a quinone group, a lactone group, a hydroxyl group, or the like to the surfaces of the carbon black particles. Examples of a method for treating the surfaces of the carbon black particles include an air oxidation method in which carbon black particles are brought into contact with air in a high temperature atmosphere; a method in which carbon black particles are caused to react with a nitrogen oxide or ozone at normal temperature (e.g., 22° C.); and a method in which carbon black particles are subjected to air oxidation in a high temperature atmosphere and subsequently oxidized with ozone at a low temperature.

The number average primary particle size of the first conductive carbon particles is, for example, 20 nm or less. In order to adjust the L(r) integral to fall within the above-described range, the number average primary particle size of the first conductive carbon particles is preferably 18 nm or less, is more preferably 15 nm or less, and is further preferably 13 nm or less. The number average primary particle size of the first conductive carbon particles is, for example, 2 nm or more. In order to adjust the L(r) integral to fall within the above range, the number average primary particle size of the first conductive carbon particles is preferably 5 nm or more and is more preferably 10 nm or more.

The number average primary particle size of the second conductive carbon particles is, for example, 2 nm or more and 40 nm or less. In consideration of dispersibility, mechanical strength, volume resistivity, film formability, and the like, the number average primary particle size of the second conductive carbon particles is preferably 20 nm or more and 40 nm or less, is more preferably 20 nm or more and 35 nm or less, and is further preferably 20 nm or more and 28 nm or less.

In the case where the endless belt includes the first and second layers, the first conductive carbon particles may have a smaller number average primary particle size than the second conductive carbon particles. The number average primary particle size of the first conductive carbon particles is preferably 0.5 times or more and less than 1.0 times, is more preferably 0.5 times or more and 0.8 times or less, and is further preferably 0.5 times or more and 0.7 times or less the number average primary particle size of the second conductive carbon particles.

The number average primary particle size of the conductive carbon particles is measured by the following method.

First, a sample having a thickness of 100 nm is taken from each of the layers constituting the belt with a microtome. The sample is observed with a transmission electron microscope (TEM). For each of 50 conductive carbon particles, the diameter of a circle having an area equal to the projected area of the conductive carbon particle, that is, the equivalent circle diameter of the conductive carbon particle, is calculated as the particle size of the conductive carbon particle. The average of the particle sizes of the 50 conductive carbon particles is considered the number average primary particle size of the conductive carbon particles.

In the case where the first resin includes at least one selected from the group consisting of a polyimide resin and a polyamide imide resin and the single layer or the first layer is formed using the first coating liquid described below, the first conductive carbon particles are preferably channel black particles and are more preferably surface treated channel black particles in order to adjust the L(r) integral to fall within the above range.

In the case where the single layer or the first layer is formed using the first coating liquid, the pH of the first conductive carbon particles is, for example, 1.0 or more and 5.5 or less. In order to adjust the L(r) integral to fall within the above range, the pH of the first conductive carbon particles may be 1.0 or more and 3.0 or less.

In the case where the second layer is formed using the second coating liquid described below, the pH of the second conductive carbon particles is, for example, 1.0 or more and 5.5 or less. In order to adjust the L(r) integral to fall within the above range, the pH of the second conductive carbon particles may be 1.0 or more and 3.0 or less.

In the case where the endless belt includes the first layer formed using the first coating liquid and the second layer formed using the second coating liquid, the first conductive carbon particles may have a lower pH than the second conductive carbon particles.

In the case where the first resin includes at least one selected from the group consisting of a polyetherimide resin, an aromatic polyether ether ketone resin, and a polyphenylene sulfide resin and the single layer or the first layer is formed by the melt extrusion method described below, the first conductive carbon particles are preferably channel black particles or furnace black particles and are more preferably channel black particles or furnace black particles the surfaces of which have not been treated, in order to adjust the L(r) integral to fall within the above range.

The first conductive carbon particles may be only one type of conductive carbon particles or a mixture of two or more types of conductive carbon particles.

Specific examples of the second conductive carbon particles included in the second layer are the same as the above-described specific examples of the first conductive carbon particles.

The content of the first conductive carbon particles in the entire single layer is 10% by mass or more and 50% by mass or less, is more preferably 13% by mass or more and 40% by mass or less, and is further preferably 15% by mass or more and 30% by mass or less in order to reduce the L(r) integral and maintain strength.

The content of the first conductive carbon particles in the entire first layer is 10% by mass or more and 50% by mass or less, is more preferably 13% by mass or more and 40% by mass or less, and is further preferably 15% by mass or more and 30% by mass or less in order to reduce the L(r) integral and maintain strength.

The content of the second conductive carbon particles in the entire second layer is 5% by mass or more and 40% by mass or less, is more preferably 10% by mass or more and 30% by mass or less, and is further preferably 20% by mass or more and 30% by mass or less in consideration of dispersibility, mechanical strength, and adjustment of volume resistivity.

Other Component

The single layer, the first layer, and the second layer may further include a component other than the above-described resin or the above-described conductive carbon particles.

Examples of the other component include a conductant agent other than the conductive carbon particles; a filler that increases the strength of the belt; an antioxidant that reduces the thermal degradation of the belt; a surfactant that enhances flowability; and a heat aging inhibitor.

In the case where any of the above layers includes the other component, the amount of the other component included in the layer is preferably more than 0% by mass and 10% by mass or less, is more preferably more than 0% by mass and 5% by mass or less, and is further preferably more than 0% by mass and 1% by mass or less of the total amount of the layer.

Properties of Endless Belt

Thickness of Endless Belt

The thickness of the single layer is preferably 60 μm or more and 120 μm or less and is more preferably 80 μm or more and 120 μm or less in consideration of the mechanical strength of the belt.

The thickness of the first layer is preferably 1 μm or more and 60 μm or less and is more preferably 3 μm or more and 60 μm or less in consideration of productivity and reduction in discharge.

The thickness of the second layer is preferably 10 μm or more and 80 μm or less and is more preferably 20 μm or more and 40 μm or less in consideration of the mechanical strength of the belt.

In the case where the endless belt includes the first and second layers, the proportion of the thickness of the first layer to the overall thickness of the endless belt is preferably 3% or more and 90% or less and is more preferably 5% or more and 80% or less in consideration of the transferability to rough surface paper.

The thicknesses of the above layers are measured in the following manner.

Specifically, a cross section of the endless belt in the thickness direction is observed with an optical microscope or a scanning electron microscope. The thickness of each of the layers that are to be measured is measured at ten positions, and the average thereof is considered the thickness of the layer.

Potential Attenuation Rate of Endless Belt

The rate dV/dt at which the potential is attenuated after the outer peripheral surface of the endless belt is charged to +500 V (hereinafter, the above rate is referred to simply as "potential attenuation rate") is preferably 2.0 V/msec or more and 6.0 V/msec or less, is more preferably 2.3 V/msec or more and 5.2 V/msec or less, and is further preferably 2.3 V/msec or more and 3.8 V/msec or less in consideration of the transferability to rough surface paper.

That is, the endless belt has an L(r) integral of 0 or more and 0.1 or less and may have a potential attenuation rate of 2.0 V/msec or more and 6.0 V/msec or less. In particular, even in the case where the endless belt is a multilayer body, limiting the L(r) integral to be 0 or more and 0.1 or less and the potential attenuation rate to be 2.0 V/msec or more and 6.0 V/msec or less may enhance transferability to rough surface paper.

The reasons for which the transferability to rough surface paper is enhanced when the L(r) integral of the endless belt is 0 or more and 0.1 or less and the potential attenuation rate of the endless belt is 2.0 V/msec or more and 6.0 V/msec or less are not clear but presumably as follows.

In the case where the endless belt is used as an intermediate transfer body of an image forming apparatus, for example, a transfer electric field is applied to a region in which a toner image is transferred from the intermediate transfer body to a recording medium (hereinafter, the above region may be referred to as "second transfer region") from the inner peripheral surface-side of the intermediate transfer body. Upon the intermediate transfer body passing through the second transfer region, electric charge is generated on the inner peripheral surface of the intermediate transfer body due to the transfer electric field. The electric charge migrates inside the intermediate transfer body and reaches the outer peripheral surface of the intermediate transfer body.

For example, in a high-speed image forming apparatus in which a recording medium is transported through the second transfer region at a speed of 300 mm/s or more, abnormal discharge is likely to occur if a large amount of electric charge reaches the outer peripheral surface of the intermediate transfer body while the intermediate transfer body passes through the second transfer region. On the other hand, if the amount of the electric charge that reaches the outer peripheral surface of the intermediate transfer body while the intermediate transfer body passes through the second transfer region is excessively small, the amount of electric charge stored in the toner may be reduced as a result of electric charge migrating from the toner into the intermediate transfer body. This may degrade transferability.

In contrast, when the L(r) integral of the endless belt is 0 or more and 0.1 or less and the potential attenuation rate of the endless belt is 2.0 V/msec or more and 6.0 V/msec or less, the amount of the electric charge that reaches the outer peripheral surface of the intermediate transfer body while the intermediate transfer body passes through the second transfer region may be adequate even when the endless belt is used an intermediate transfer body of a high-speed image forming apparatus. Furthermore, since the conducting points are finely dispersed on the outer peripheral surface of the intermediate transfer body, the occurrence of abnormal discharge and the reduction in the amount of charge stored in the toner may be limited. This may enhance transferability.

The potential attenuation rate of the endless belt is determined by bonding a piece of the belt having a size of 50 mm×60 mm to an insulating plate, attaching a surface electrometer (e.g., surface electrometer "314" produced by TREK Japan) onto the surface (i.e., the outer peripheral surface) of the belt, charging the piece of the belt to 500 V with a scorotron having an opening width of 18 mm and a grid voltage of 580 V, and subsequently measuring the potential of the surface of the belt immediately after charging and after attenuation at intervals of 10 msec.

A method for controlling the potential attenuation rate of the endless belt is not limited. Examples of the method include a method in which the number average primary particle size and type of the conductive carbon particles used are selected appropriately; and a method in which the conditions under which the endless belt is produced (e.g., drying conditions) are adjusted. In particular, in the case where the endless belt is a multilayer body, the potential attenuation rate of the endless belt may be controlled by changing the conditions under which the surface layer is dried, the conditions under which the substrate layer is dried, and the combination of the conditions under which the surface layer is dried and the conditions under which the substrate layer is dried.

The speed at which the image forming apparatus that includes the endless belt having a potential attenuation rate of 2.0 V/msec or more and 6.0 V/msec or less transports a recording medium, that is, the speed at which a recording medium is transported through the second transfer region, is preferably 50 mm/s or more and 600 mm/s or less, is more preferably 100 mm/s or more and 600 mm/s or less, and is further preferably 300 mm/s or more and 600 mm/s or less.

Volume Resistivity of Endless Belt The common logarithm of the volume resistivity of the endless belt measured when a voltage of 500 V is applied to the endless belt for 10 seconds is preferably 9.0 log Ω·cm or more and 13.5 log Ω·cm or less, is more preferably 9.5 log Ω·cm or more and 13.2 log Ω·cm or less, and is particularly preferably 10.0 log Ω·cm or more and 12.5 log Ω·cm or less in consideration of the transferability to rough surface paper.

The volume resistivity of the endless belt measured when a voltage of 500 V is applied to the endless belt for 10 seconds is determined by the following method.

The volume resistivity [log Ω·cm] of the endless belt is measured using a micro current meter "R8430A" produced by Advantest Corporation as a resistance meter and a UR probe produced by Mitsubishi Chemical Analytech Co., Ltd. as a probe at the center and both edges of the endless belt in the width direction for each of 6 positions spaced at regular intervals in the circumferential direction, that is, 18 positions in total, with an applied voltage of 500 V, a voltage application time of 10 seconds, and a pressure of 1 kgf. The average of the volume resistivity values measured is calculated. The above measurement is conducted at 22° C. and 55% RH.

Surface Resistivity of Endless Belt

The common logarithm of the surface resistivity of the outer peripheral surface of the endless belt measured when a voltage of 500 V is applied to the outer peripheral surface of the endless belt for 10 seconds is preferably 10.0 log Ω/suq. or more and 15.0 log Ω/suq. or less, is more preferably 10.5 log Ω/suq. or more and 14.0 log Ω/suq. or less, and is particularly preferably 11.0 log Ω/suq. or more and 13.5 log Ω/suq. or less in consideration of the transferability to rough surface paper.

The unit of surface resistivity "log Ω/suq." represents surface resistivity with a logarithm of resistance value per unit area and also denoted by log(Ω/suq.), log Ω/square, log Ω/□, etc.

The surface resistivity of the outer peripheral surface of the endless belt measured when a voltage of 500 V is applied to the outer peripheral surface of the endless belt for 10 seconds is measured by the following method.

The surface resistivity [log Ω/suq.] of the outer peripheral surface of the endless belt is measured using a micro current meter "R8430A" produced by Advantest Corporation as a resistance meter and a UR probe produced by Mitsubishi Chemical Analytech Co., Ltd. as a probe at the center and both edges of the outer peripheral surface of the endless belt in the width direction for each of 6 positions spaced at regular intervals in the circumferential direction, that is, 18 positions in total, with an applied voltage of 500 V, a voltage application time of 10 seconds, and a pressure of 1 kgf. The average of the surface resistivity values measured is calculated. The above measurement is conducted at 22° C. and 55% RH.

Method for Producing Endless Belt

A method for producing the endless belt according to the exemplary embodiment is not limited.

An example of the method for producing the endless belt includes preparing a first coating liquid that includes the first resin or a precursor thereof, the first conductive carbon particles, and a first solvent (hereinafter, this step is referred to as "first coating liquid preparing step"); applying the first coating liquid onto the outer periphery of a member to form a first coating film (hereinafter, this step is referred to as "first coating film forming step"); and drying the first coating film while increasing the temperature of the member (hereinafter, this step is referred to as "first drying step"). The method for producing the endless belt may include a step other than the first coating liquid preparing step, the first coating film forming step, or the first drying step. For example, in the case where a precursor of the first resin is used, examples of the other step include baking the first coating film dried in the first drying step (hereinafter, this step is referred to as "first baking step").

In the case where a single-layer endless belt is produced, the single layer including the first resin and the first conductive carbon particles is formed on the outer peripheral surface of the member by conducting the first coating liquid preparing step, the first coating film forming step, and the first drying step. Alternatively, the single layer may be formed by, for example, preparing pellets that include the first resin and the first conductive carbon particles and forming the pellets into a predetermined shape by melt extrusion.

In the case where a multilayer endless belt is produced, the first layer including the first resin and the first conductive carbon particles is formed on the outer peripheral surface of the second layer formed on the member by conducting, for example, the first coating liquid preparing step, the first coating film forming step, and the first drying step.

In the case where a multilayer endless belt is produced, the second layer is formed on the outer peripheral surface of a member by, for example, preparing a second coating liquid that includes the second resin or a precursor thereof, the second conductive carbon particles, and a second solvent (hereinafter, this step is referred to as "second coating liquid preparing step"); applying the second coating liquid onto the outer periphery of a member to form a second coating film (hereinafter, this step is referred to as "second coating film forming step"); and drying the second coating film (hereinafter, this step is referred to as "second drying step"). Alternatively, the second layer may be formed by, for example, preparing pellets that include the second resin and the second conductive carbon particles and forming the pellets into a predetermined shape by melt extrusion.

Coating Liquid Preparing Step

In the first coating liquid preparing step, a first coating liquid that includes the first resin or a precursor thereof, the first conductive carbon particles, and a first solvent is prepared. For example, in the case where the first resin is a polyimide resin and the first conductive carbon particles are carbon black particles, a solution that includes, for example, carbon black particles dispersed therein, a first solvent, and polyamic acid (i.e., a precursor of a polyimide resin) dissolved in the first solvent is prepared as a first coating liquid. For example, in the case where the first resin is a polyamide imide resin and the first conductive carbon particles are carbon black particles, a solution that includes, for example, carbon black particles dispersed therein, a first solvent, and a polyamide imide resin dissolved in the first solvent is prepared as a first coating liquid.

In the preparation of the first coating liquid, the dispersion treatment may be performed using a pulverizer, such as a ball mill or jet mill, in order to disintegrate aggregates of the first conductive carbon particles and enhance the dispersibility of the first conductive carbon particles.

The first solvent is not limited and may be selected appropriately in accordance with the type, etc. of the resin used as a first resin. For example, in the case where the first resin is a polyimide resin or a polyamide imide resin, the polar solvent described below may be used as a first solvent.

Examples of the polar solvent include N-methyl-2-pyrrolidone (NMP), N,N-dimethylformamide (DMF), N,N-dimethylacetamide (DMAc), N,N-diethylacetamide (DEAc), dimethyl sulfoxide (DMSO), hexamethylphosphoramide (HMPA), N-methylcaprolactam, N-acetyl-2-pyrrolidone, and 1,3-dimethyl-2-imidazolidinone (N,N-dimethylimidazolidinone, DMI). The above polar solvents may be used alone or in combination of two or more.

In the case where the method for producing the endless belt includes the second coating liquid preparing step, in the second coating liquid preparing step, a second coating liquid that includes the second resin, the second conductive carbon particles, and a second solvent is prepared. The second resin and the second conductive carbon particles are as described above. A method for preparing the second coating liquid and the second solvent are the same as the method for preparing the first coating liquid and the first solvent, respectively.

Coating Film Forming Step

In the first coating film forming step, the first coating liquid is applied onto the outer periphery of a member to form a first coating film.

Examples of the member to which the coating liquid is applied include a hollow cylindrical or solid cylindrical mold. The member may be prepared by treating the outer peripheral surface of the above mold with a release agent. In the case where a single-layer endless belt is produced, in the first coating film forming step, for example, the first coating liquid is directly applied onto the outer peripheral surface of the member or the member treated with a release agent. In the case where a multilayer endless belt is produced, in the first coating film forming step, for example, the first coating liquid is applied to the second layer or onto the outer peripheral surface of the member on which the second coating film is formed.

Examples of a method for applying the first coating liquid include the following known coating methods: spray coating, spiral coating (i.e., flow coating), blade coating, wire bar coating, dip coating, bead coating, air knife coating, and curtain coating.

In the case where the method for producing the endless belt includes the second coating film forming step, in the second coating film forming step, the second coating liquid is applied onto the outer periphery of the member to form a second coating film. A method for applying the second coating liquid is the same as the method for applying the first coating liquid.

Drying Step

In the first drying step, the first coating film formed in the first coating film forming step is dried. The first drying step removes the first solvent included in the first coating film. Consequently, the single layer or the first layer is formed.

Examples of a method for drying the first coating film include a method in which hot air is fed to the first coating film; and a method in which the member is heated.

In the first drying step, when the integral average of the temperature of the member on the drying step is represented by A [° C.] and the amount of time it takes for the temperature of the member to reach the integral average A [° C.] after the drying is started is represented by B [min], an integral average temperature rise rate A/B [° C./min] may be 5.74° C./min or more. When the integral average temperature rise rate A/B [° C./min] is 5.74° C./min or more, the endless belt may achieve excellent transferability to rough surface paper when used as an intermediate transfer body. The reasons are not clear but presumably as follows.

Specifically, when the integral average temperature rise rate A/B is high, the first coating film can be dried in a short time. This enables the first conductive carbon particles to be fixed in position before aggregating in the first coating film. Consequently, a layer that includes the first conductive carbon particles dispersed therein in a suitable manner may be formed. Since the first conductive carbon particles are finely dispersed in the layer, the L(r) integral is likely to fall within the range of 0 or more and 0.1 or less. Accordingly, an endless belt that may achieve excellent transferability to rough surface paper when used as an intermediate transfer body may be produced.

The integral average temperature rise rate A/B is determined by the following method: the variation in the temperature of the member in the drying step with time is measured with a thermometer (e.g., a Type K thermocouple "JBS-7115-5M-K" produced by Graphtec Corporation) connected to a data recorder "GL240" produced by Graphtec Corporation; the temperature at which the integral (i.e., area) of the temperature of the member from the start of drying is half the integral (i.e., area) of the temperature of the member from the start of drying to the termination of drying is determined as "integral average A [° C.]"; the amount of time B [min] it takes for the temperature of the member to reach the integral average A [° C.] after drying is started is measured; and the integral average temperature rise rate A/B [° C./min] is calculated.

The integral average temperature rise rate A/B [° C./min] is more preferably 5.74° C./min or more and is further preferably 8.0° C./min or more.

A method for controlling the integral average temperature rise rate A/B to fall within the above range is not limited. For example, in the case where the first coating film is dried by feeding hot air onto the surface of the first coating film, the velocity of the hot air on the surface of the first coating film may be adjust appropriately. In another case, the temperature of the hot air may be adjusted appropriately.

The velocity of the hot air on the surface of the first coating film is, for example, 0.1 m/s or more and 50 m/s or less, is preferably 1 m/s or more and 40 m/s or less, and is more preferably 1 m/s or more and 20 m/s or less.

The velocity of the hot air on the surface of the first coating film is measured in the following manner. Specifically, in the measurement, an anemometer "TM350" produced by TASCO is used with a probe attached to the surface of the coating film.

The temperature of the hot air on the surface of the first coating film is, for example, 100° C. or more and 280° C. or less, is preferably 100° C. or more and 250° C. or less, and is more preferably 110° C. or more and 235° C. or less.

The temperature of the hot air on the surface of the first coating film is measured with a thermometer (e.g., a Type K thermocouple "JBS-7115-5M-K" produced by Graphtec Corporation) connected to a data recorder "GL240" produced by Graphtec Corporation.

A method for feeding hot air to the surface of the first coating film is not limited. Examples of the method include a method in which hot air generated in a drying furnace is blown through a slit nozzle against the surface of the first coating film; and a method in which hot air generated in a drying furnace is fed directly to the first coating film. Among these methods, the method in which a slit nozzle is used may be used in order to increase ease of control of the velocity of the hot air on the surface of the first coating film.

In the case where the method for producing the endless belt includes the second drying step, in the second drying step, the second coating film formed in the second coating film forming step is dried. A method for drying the second coating film is the same as the method for drying the first coating film. The second drying step may be completed prior to the first coating film forming step. Alternatively, the first coating film forming step may be started before the second drying step is completed. In such a case, the first drying step may also serve as part of the second drying step.

Baking Step

As described above, the method for producing the endless belt may include the first baking step. In the first baking step, the first coating film dried in the first drying step is baked by heating. For example, in the case where the first resin is a polyimide resin, the first baking step causes imidization of the polyamic acid included in the first coating film to produce polyimide.

The heating temperature in the first baking step is, for example, 150° C. or more and 450° C. or less and is preferably 200° C. or more and 430° C. or less. The amount of time during which heating is performed in the first baking step is, for example, 20 minutes or more and 180 minutes or less and is preferably 60 minutes or more and 150 minutes or less.

In the case where a multilayer endless belt is produced and the second layer is formed by conducting the second coating liquid preparing step, the second coating film forming step, and the second drying step, the method for producing the endless belt may include a second baking step in which the second coating film dried in the second drying step is baked. The second baking step may also serve as the first baking step.

Transfer Device

A transfer device according to the exemplary embodiment includes an intermediate transfer body; a first transfer unit that transfers a toner image formed on the surface of an image holding member onto the surface of the intermediate transfer body as first transfer; and a second transfer unit that transfers the toner image transferred on the surface of the intermediate transfer body onto the surface of a recording medium as second transfer. The intermediate transfer body is the above-described endless belt.

The first transfer unit includes, for example, a first transfer roller arranged to face the image holding member across the intermediate transfer body that is the endless belt. In the first transfer unit, the first transfer roller applies a voltage having a polarity opposite to the polarity of the charge of a toner to the intermediate transfer body. This causes a toner image to be transferred onto the outer peripheral surface of the intermediate transfer body as first transfer.

The second transfer unit includes, for example, a second transfer roller disposed on a side of the intermediate transfer body on which a toner image is held; and a backing roller disposed on a side of the intermediate transfer body which is opposite to the side on which a toner image is held. In the second transfer unit, the intermediate transfer body and a recording medium are sandwiched between the second transfer roller and the backing roller and a transfer electric field is generated. This causes the toner image present on the intermediate transfer body to be transferred to a recording medium as second transfer.

The transfer device according to the exemplary embodiment includes the above-described endless belt as an intermediate transfer body. Accordingly, even when a high electric field is applied to the second transfer unit for second transfer, abnormal discharge is not likely to occur and excellent transferability to rough surface paper may be achieved.

The first transfer roller included in the first transfer unit may be a conductive roller including an outermost layer that is an elastic foam layer that includes an epichlorohydrin rubber and an electron-conductive conductant agent.

The difference between the common logarithm of the resistance value of the elastic foam layer at 28° C. and 86 RH %, that is, in a high temperature, high humidity environment, and the common logarithm of the resistance value of the elastic foam layer at 10° C. and 15 RH %, that is, in a low temperature, low humidity environment, (hereinafter, the above difference may be referred to as "environmental resistance variation") is preferably 0.6 log Ω or less, is more preferably 0.1 log Ω or more and 0.6 log Ω or less, and is further preferably 0.1 log Ω or more and 0.4 log Ω or less.

Using, as an intermediate transfer body, the endless belt having an L(r) integral of 0 or more and 0.1 or less and, as a first transfer roller, the conductive roller including the elastic foam layer that includes an epichlorohydrin rubber and an electron-conductive conductant agent and has an environmental resistance variation of 0.1 log Ω or more and 0.6 log Ω or less may enhance the transferability to rough surface paper particularly in a low temperature, low humidity environment (e.g., at 10° C. and 15 RH %). The reasons are not clear but presumably as follows.

When a first transfer roller including the elastic foam layer having a small environmental resistance variation is used, a sufficient electric field may be applied to the first transfer region, in which a toner image is transferred from an image holding member to an intermediate transfer body, regardless of the environment, and the toner image may be transported into the second transfer region (i.e., the region in which a toner image is transferred from an intermediate transfer body to a recording medium) while the entire toner image is charged to a sufficient degree and inconsistencies in the amount of electric charge are small. In addition, since the L(r) integral of the intermediate transfer body is 0 or more and 0.1 or less, a sufficient transfer electric field may be generated even in the recesses present in a recording medium and the likelihood of occurrence of abnormal discharge is low. Consequently, the transferability to rough surface paper in a low temperature, low humidity environment may be enhanced.

The environmental resistance variation of the elastic foam layer is determined in the following manner.

Specifically, the conductive roller is held by a roller resistance meter. Subsequently, the electrode is brought into contact with the elastic foam layer. The resistance value of the elastic foam layer at 10° C. and 15 RH % and the resistance value of the elastic foam layer at 28° C. and 85 RH % are measured with a resistance meter (e.g., "8340A" produced by ADC Corporation). The difference between the common logarithms of the two resistance values is calculated as an environmental resistance variation. The above resistance values are measured when a voltage of 10 V is applied to the elastic foam layer for 5 sec.

Examples of a method for controlling the environmental resistance variation of the elastic foam layer include a method in which the types of the epichlorohydrin rubber and electron-conductive conductant agent used are changed and the proportions of the epichlorohydrin rubber and electron-conductive conductant agent used are adjusted appropriately.

A conductive roller having an outermost layer that is an elastic foam layer including an epichlorohydrin rubber and an electron-conductive conductant agent is described below.

Conductive Roller

The conductive roller includes, for example, a supporting member and an elastic foam layer disposed on the supporting member.

The supporting member serves as a supporting member used for attaching the conductive roller to an image forming apparatus and also as an electrode in the formation of images. The supporting member may be either a hollow member or a solid-core member.

The supporting member is a conductive member. Examples thereof include a metal member composed of iron (e.g., free-cutting steel), copper, brass, stainless steel, aluminum, nickel, or the like; a resin or ceramic member including a plating film deposited on the outer surface; and a resin or ceramic member that includes a conductant agent.

Elastic Foam Layer

The elastic foam layer is composed of a foam including a rubber material (i.e., an elastic material) that includes at least an epichlorohydrin rubber and an electron-conductive conductant agent. The rubber material may include a rubber other than an epichlorohydrin rubber. The foam may include another component, such as an additive.

Examples of the epichlorohydrin rubber include an epichlorohydrin homopolymer rubber; a copolymer rubber, such as an epichlorohydrin-ethylene oxide copolymer rubber, an epichlorohydrin-allyl glycidyl ether copolymer rubber, or an epichlorohydrin-ethylene oxide-allyl glycidyl ether terpolymer rubber; and a rubber produced by mixing any of the above rubbers with one another.

Examples of the other rubber include an isoprene rubber, a chloroprene rubber, a butyl rubber, polyurethane, a silicone rubber, a fluorine rubber, a styrene-butadiene rubber, a butadiene rubber, a nitrile rubber, an ethylene propylene rubber, an ethylene-propylene-diene terpolymer rubber (EPDM), an acrylonitrile-butadiene copolymer rubber (NBR), natural rubber, and a rubber produced by mixing any of the above rubbers with one another.

The rubber material is preferably a rubber prepared by mixing an epichlorohydrin rubber with the other rubber and is more preferably a rubber prepared by mixing an epichlorohydrin rubber with an acrylonitrile-butadiene copolymer rubber.

The amount of the epichlorohydrin rubber included in the rubber material is preferably 10 parts by mass or more and 100 parts by mass or less, is more preferably 20 parts by mass or more and 100 parts by mass or less, is further preferably 30 parts by mass or more and 100 parts by mass or less, is particularly preferably 30 parts by mass or more and 80 parts by mass or less, and is most preferably 30 parts by mass or more and 60 parts by mass or less relative to 100 parts by mass of the rubber material in order to reduce the environmental resistance variation.

Examples of the electron-conductive conductant agent include a powder of carbon black, such as Ketjenblack or acetylene black; a powder of pyrolytic carbon or graphite; a powder of a metal, such as aluminum, copper, nickel, or stainless steel or an alloy thereof; a powder of a conductive metal oxide, such as tin oxide, indium oxide, titanium oxide, a tin oxide-antimony oxide solid solution, or a tin oxide-indium oxide solid solution; and a powder of a substance produced by making the surfaces of powder particles of an insulating material electrically conductive. The above electron-conductive conductant agents may be used alone or in combination of two or more.

Among the above electron-conductive conductant agents, carbon black may be used. The number average primary particle size of the electron-conductive conductant agent is preferably 10 nm or more and 150 nm or less, is more preferably 20 nm or more and 100 nm or less, and is further preferably 30 nm or more and 80 nm or less.

The amount of the carbon black included in the elastic foam layer is preferably 10 parts by mass or more and 70 parts by mass or less and is more preferably 20 parts by mass or more and 60 parts by mass or less relative to 100 parts by mass of the rubber material in order to reduce the environmental resistance variation of the elastic foam layer.

The elastic foam layer may include a foaming agent as an additive.

Examples of the foaming agent include water; azo compounds, such as azodicarbonamide, azobisisobutyronitrile, and diazoaminobenzene; benzenesulfonyl hydrazides, such as benzenesulfonyl hydrazide, 4,4'-oxybisbenzenesulfonyl hydrazide, and toluenesulfonyl hydrazide; bicarbonates that release a carbon dioxide gas when decomposed by heat, such as sodium hydrogen carbonate; a mixture of $NaNO_2$ and $NH_4Cl$, which releases a nitrogen gas; and peroxides that release oxygen. Optionally, a foaming assistant, a foam stabilizer, a catalyst, and the like may be used.

The above foaming agents may be used alone or in combination of two or more.

The amount of the foaming agent used is adjusted appropriately in accordance with the properties, etc. of the rubber material used. The amount of the foaming agent used is preferably 0.1 parts by mass or more and 30 parts by mass or less, is more preferably 0.5 parts by mass or more and 20 parts by mass or less, is further preferably 1 part by mass or more and 15 parts by mass or less, and is particularly preferably 2 parts by mass or more and 10 parts by mass or less relative to 100 parts by mass of the rubber material. When the amount of the foaming agent used falls within the above range, resistance stability may be further enhanced.

The elastic foam layer may include a vulcanizing agent as an additive.

Examples of the vulcanizing agent include sulfur, an organosulfur compound, and an organic peroxide. Examples of the organosulfur compound include tetramethylthiuram disulfide and N,N'-dithiobismorpholine. Examples of the organic peroxide include dicumyl peroxide and benzoyl peroxide.

The above vulcanizing agents may be used alone or in combination of two or more.

The amount of the vulcanizing agent used is adjusted appropriately in accordance with the properties, etc. of the rubber material used. The amount of the vulcanizing agent used is preferably 0.3 parts by mass or more and 10 parts by mass or less and is more preferably 1 part by mass or more and 8 parts by mass or less relative to 100 parts by mass of the rubber material included in the elastic layer.

The elastic foam layer may include a vulcanization accelerator as an additive.

Various types of the vulcanization accelerators used in the related art may be used. In particular, a sulfenamide vulcanization accelerator may be used. The amount of the vulcanization accelerator used is preferably 0.3 parts by mass or more and 4 parts by mass or less and is more preferably 0.5 parts by mass or more and 3 parts by mass or less relative to 100 parts by mass of the rubber material.

The above vulcanization accelerators may be used alone or in combination of two or more.

The elastic foam layer may include an additive other than the above-described additives.

Examples of the other additive include various types of the additives for rubbers which are known in the related art. Specific examples thereof include a processing aid (e.g., stearic acid), a foaming assistant, a softener, a plasticizer, a curing agent, an antioxidant, a surfactant, a coupling agent, and a filler (e.g., silica or calcium carbonate).

The thickness of the elastic foam layer is not limited. The thickness of the elastic foam layer is, for example, 1 mm or more and 20 mm or less and is preferably 2 mm or more and 15 mm or less.

Method for Producing Conductive Roller

The conductive roller is produced by attaching the elastic foam layer to the supporting member. A method for attaching the elastic foam layer to the supporting member is not limited; for example, a hollow cylindrical elastic foam body is prepared, and a supporting member is inserted into the hollow cylindrical elastic foam body.

A method for forming the hollow cylindrical elastic foam layer is not limited; for example, a rubber composition including a raw material for the rubber component, the electron-conductive conductant agent, and the other additives is formed into a hollow cylindrical shape by kneading, extrusion molding, and the like and the resulting hollow cylindrical body is vulcanized and foamed to form an elastic foam layer.

The vulcanization and foaming of the rubber composition may be performed by heating. In such a case, the heating temperature may be 100° C. or more and 200° C. or less.

Image Forming Apparatus

An image forming apparatus according to the exemplary embodiment includes an image holding member; a charging device that charges the surface of the image holding member; an electrostatic-latent image forming device that forms an electrostatic latent image on the charged surface of the image holding member; a developing device that includes a developer including a toner and develops the electrostatic latent image formed on the surface of the image holding member with the developer to form a toner image; and a transfer device that transfers the toner image onto the surface of a recording medium. The transfer device is the above-described transfer device.

In the exemplary embodiment, excellent transferability to rough surface paper may be achieved even when the toner particles having a volume average particle size of 5 μm or less (hereinafter, such a toner may be referred to as "small-diameter toner") are used. Using the small-diameter toner for forming images may increase the resolution of the images and enables the formation of high-quality images. However, since the amount of charge which can be stored in a small-diameter toner per unit volume is large, abnormal discharge is likely to occur when a transfer voltage is applied to the second transfer region. Moreover, since large Van der Waals forces work between the small-diameter toner particles, the formation of white missing dots in the images may become severe if the toner becomes oppositely charged due to the abnormal discharge.

In contrast, in the exemplary embodiment, since the endless belt having an L(r) integral of 0 or more and 0.1 or less is used as an intermediate transfer body of the transfer device, the conducting points are finely dispersed on the outer peripheral surface of the intermediate transfer body and the abnormal discharge is not likely to occur. Accordingly, even when a small-diameter toner is used, the formation of white missing dots in the images may be reduced and, consequently, excellent transferability to rough surface paper may be achieved.

The volume average particle size of the toner is preferably 2 μm or more and 5 μm or less and is more preferably 3.5 μm or more and 4.8 μm or less.

The volume average particle size of the toner is measured using "COULTER MULTISIZER II" produced by Beckman Coulter, Inc. with an electrolyte "ISOTON-II" produced by Beckman Coulter, Inc. in the following manner.

A sample to be measured (0.5 mg or more and 50 mg or less) is added to 2 ml of a 5%-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER MULTISIZER II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume is calculated and plotted to draw a cumulative distribution curve. The particle diameter at which the cumulative volume reaches 50% is considered the volume average particle size.

An example of the image forming apparatus according to the exemplary embodiment is described below with reference to the attached drawing.

FIGURE is a schematic diagram illustrating the image forming apparatus according to the exemplary embodiment.

The intermediate transfer belt is the above-described endless belt. The first transfer roller is the above-described conductive roller.

A portion of the image forming apparatus according to the exemplary embodiment which includes, for example, at least the transfer device may be a cartridge structure (i.e., process cartridge) detachably attachable to the image forming apparatus.

An image forming apparatus 100 according to the exemplary embodiment is, for example, an intermediate-transfer image forming apparatus illustrated in FIGURE, which is commonly referred to as a tandem image forming apparatus. The image forming apparatus 100 includes plural image forming units 1Y, 1M, 1C, and 1K that form yellow (Y), magenta (M), cyan (C), and black (K) toner images by an electrophotographic system; a first transfer section 10 (i.e., a first transfer region) in which the yellow, magenta, cyan, and black toner images formed by the image forming units 1Y, 1M, 1C, and 1K are sequentially transferred (first transfer) to an intermediate transfer belt 15; a second transfer section 20 (i.e., a second transfer region) in which the superimposed toner images transferred on the intermediate transfer belt 15 are collectively transferred (second transfer) to a paper sheet K, which is an example of the recording medium; and a fixing device 60 that fixes the image transferred on the paper sheet K by second transfer to the paper sheet K. The image forming apparatus 100 also includes a controller 40 that controls the operation of each of the devices and the sections.

Each of the image forming units 1Y, 1M, 1C, and 1K included in the image forming apparatus 100 includes a photosensitive member 11 (an example of the image holding member) that rotates in the direction of the arrow A, which is an example of the image holding member that holds a toner image formed on the surface.

The photosensitive member 11 is provided with a charger 12 (an example of the charging device) and a laser exposure machine 13 (an example of the electrostatic latent image forming device) which are disposed on the periphery of the photosensitive member 11. The charger 12 charges the photosensitive member 11. The laser exposure machine 13 writes an electrostatic latent image on the photosensitive member 11 (in FIGURE, an exposure beam is denoted with Bm).

The photosensitive member 11 is also provided with a developing machine 14 (an example of the developing device) and a first transfer roller 16 which are disposed on the periphery of the photosensitive member 11. The developing machine 14 includes a yellow, magenta, cyan, or black toner and visualizes the electrostatic latent image formed on the photosensitive member 11 with the toner. The first transfer roller 16 transfers the yellow, magenta, cyan, or black toner image formed on the photosensitive member 11 to the intermediate transfer belt 15 in the first transfer section 10.

The photosensitive member 11 is further provided with a photosensitive member cleaner 17 disposed on the periphery of the photosensitive member 11. The photosensitive member cleaner 17 removes toner particles remaining on the photosensitive member 11. The above-described electrophotographic devices, that is, the charger 12, the laser exposure machine 13, the developing machine 14, the first transfer roller 16, and photosensitive member cleaner 17, are sequentially arranged on the periphery of the photosensitive member 11 in the direction of the rotation of the photosensitive member 11. The image forming units 1Y, 1M, 1C, and 1K are arranged in a substantially linear manner in the order of yellow (Y), magenta (M), cyan (C), and black (K) in the direction of the rotation of the intermediate transfer belt 15.

The intermediate transfer belt 15, which serves as an intermediate transfer body, has a volume resistivity of, for example, $1\times10^{6}$ Ωcm or more and $1\times10^{14}$ Ωcm or less and a thickness of, for example, about 0.1 mm.

The intermediate transfer belt 15 is driven in a circulatory manner (i.e., rotated), by various types of rollers at an intended speed in the direction of the arrow B illustrated in FIGURE. The various types of rollers include a driving roller 31 that is driven by a highly-constant-speed motor (not illustrated) and rotates the intermediate transfer belt 15; a support roller 32 that supports the intermediate transfer belt 15 that extends in a substantially linear manner in the direction in which the photosensitive members 11 are arranged; a tension roller 33 that applies tension to the intermediate transfer belt 15 and serves as a correction roller that prevents meandering of the intermediate transfer belt 15; a backing roller 25 disposed in the second transfer section 20; and a cleaning backing roller 34 disposed on a cleaning section in which toner particles remaining on the intermediate transfer belt 15 are scraped off.

The first transfer section 10 is constituted by first transfer rollers 16 that are arranged to face the respective photosensitive members 11 across the intermediate transfer belt 15. The first transfer rollers 16 are arranged to be in pressure contact with the photosensitive members 11 with the intermediate transfer belt 15 interposed between the first transfer rollers 16 and the photosensitive members 11. The first transfer rollers 16 are supplied with a voltage (first transfer bias) having a polarity opposite to the polarity (negative; the same applies hereinafter) of charged toner particles. Accordingly, toner images formed on the photosensitive members 11 are electrostatically attracted to the intermediate transfer belt 15 sequentially to form superimposed toner images on the intermediate transfer belt 15.

The second transfer section 20 is constituted by the backing roller 25 and a second transfer roller 22 disposed on a side of the intermediate transfer belt 15 on which the toner image is held.

The backing roller 25 has a surface resistivity of $1\times10^{7}$ Ω/suq. or more and $1\times10^{10}$ Ω/suq. or less. The degree of hardness of the backing roller 25 is set to, for example, 70° ("ASKER C" produced by KOBUNSHI KEIKI CO., LTD.; the same applies hereinafter). The backing roller 25 is disposed on the rear surface-side of the intermediate transfer belt 15 and serves as a counter electrode for the second transfer roller 22. The backing roller 25 is provided with a power feed roller 26 made of a metal, through which a second transfer bias is applied in a consistent manner.

The second transfer roller 22 is a hollow cylindrical roller having a volume resistivity of $10^{7.5}$ Ωcm or more and $10^{8.5}$ Ωcm or less. The second transfer roller 22 is arranged to be in pressure contact with the backing roller 25 with the intermediate transfer belt 15 interposed between the second transfer roller 22 and the backing roller 25. The second transfer roller 22 is grounded. A second transfer bias is formed between the second transfer roller 22 and the backing roller 25. Accordingly, the toner image is transferred (second transfer) to a paper sheet K transported to the second transfer section 20.

The speed at which the paper sheet K is transported in the second transfer section 20 is, for example, 50 mm/s or more and 600 mm/s or less.

An intermediate transfer belt cleaner 35 is disposed on the intermediate transfer belt 15 at a position downstream of the second transfer section 20 such that the distance between the intermediate transfer belt cleaner 35 and the intermediate transfer belt 15 can be changed. The intermediate transfer belt cleaner 35 removes toner particles and paper dust particles that remain on the intermediate transfer belt 15 subsequent to the second transfer and cleans the surface of the intermediate transfer belt 15.

The intermediate transfer belt 15, the first transfer section 10 (i.e., the first transfer rollers 16), and the second transfer section 20 (i.e., the second transfer roller 22) correspond to examples of the transfer device.

A reference sensor (home position sensor) 42 is disposed upstream of the yellow image forming unit 1Y. The reference sensor (home position sensor) 42 generates a reference signal used as a reference to determine the timings at which images are formed in the image forming units 1Y, 1M, 1C, and 1K. An image density sensor 43 is disposed downstream of the black image forming unit 1K. The image density sensor 43 is used for adjusting image quality. The reference sensor 42 generates the reference signal upon recognizing a mark disposed on the back side of the intermediate transfer belt 15. Upon recognizing the reference signal, the controller 40 sends a command to the image forming units 1Y, 1M, 1C, and 1K. Each of the image forming units 1Y, 1M, 1C, and 1K starts forming an image in accordance with the command.

The image forming apparatus according to the exemplary embodiment further includes the following components as units for transporting paper sheets K: a paper tray 50 that contains paper sheets K; a paper feed roller 51 that draws and transports a paper sheet K stocked in the paper tray 50 at predetermined timings; transport rollers 52 that transport the paper sheet K drawn by the paper feed roller 51; a transport guide 53 with which the paper sheet K transported by the transport rollers 52 is fed into the second transfer section 20; a transport belt 55 that transports the paper sheet K that has been subjected to the second transfer with the second transfer roller 22 to the fixing device 60; and a fixing entrance guide 56 with which the paper sheet K is introduced into the fixing device 60.

A fundamental process for forming an image using the image forming apparatus according to the exemplary embodiment is described below.

In image forming apparatus according to the exemplary embodiment, image data sent from an image reading apparatus (not illustrated), a personal computer (PC, not illustrated), or the like are subjected to image processing using an image processing apparatus (not illustrated) and, subsequently, the image forming units 1Y, 1M, 1C, and 1K form images.

In the image processing apparatus, the input reflectance data are subjected to image processing that includes various types of image editing, such as shading correction, misalignment correction, lightness/color space conversion, gamma correction, frame removal, color editing, and image moving. The image data that have been subjected to the image processing are converted into yellow, magenta, cyan, and black colorant gradation data and sent to the laser exposure machines 13.

In accordance with the colorant gradation data received by each of the laser exposure machines 13, the laser exposure machine 13 irradiates the photosensitive member 11 included in each of the image forming units 1Y, 1M, 1C, and 1K with an exposure beam Bm emitted from a semiconductor laser or the like. After the surface of the photosensitive member 11 of each of the image forming units 1Y, 1M, 1C, and 1K has been charged by the charger 12, the surface of the photosensitive member 11 is scanned by the laser exposure machine 13 and exposed to the beam and, consequently, an electrostatic latent image is formed on the surface of the photosensitive member 11. The electrostatic latent image is developed in each of the image forming units 1Y, 1M, 1C, and 1K as Y, M, C, or K toner image.

The toner images formed on the photosensitive members 11 of the image forming units 1Y, 1M, 1C, and 1K are transferred to the intermediate transfer belt 15 in the first transfer section 10 in which the photosensitive members 11 come into contact with the intermediate transfer belt 15. Specifically, in the first transfer section 10, the first transfer rollers 16 apply a voltage (first transfer bias) having a polarity opposite to the polarity (negative) of charged toner particles to the base of the intermediate transfer belt 15 and the toner images are sequentially superimposed on the surface of the intermediate transfer belt 15 (first transfer).

After the toner images have been sequentially transferred (first transfer) onto the surface of the intermediate transfer belt 15, the intermediate transfer belt 15 is moved and the toner images are transported to the second transfer section 20. When the toner images are transported to the second transfer section 20, in the transport unit, the paper feed roller 51 starts rotating and feeds a paper sheet K having an intended size from the paper tray 50 in synchronization with the transportation of the toner images to the second transfer section 20. The paper sheet K fed by the paper feed roller 51 is transported by the transport rollers 52 and reaches the second transfer section 20 through the transport guide 53. Before the paper sheet K reaches the second transfer section 20, the feeding of the paper sheet K is temporarily paused and an alignment between the paper sheet K and the toner images is made by an alignment roller (not illustrated) being rotated in synchronization with the movement of the intermediate transfer belt 15 on which the toner images are held. For example, even in the case where the paper sheet K is a paper sheet having surface irregularities, such as an embossed paper sheet, suitable transferability to the paper sheet K may be achieved.

In the second transfer section 20, the second transfer roller 22 is pressed by the backing roller 25 with the intermediate transfer belt 15 interposed between the second transfer roller 22 and the backing roller 25. The paper sheet K transported to the second transfer section 20 at the intended timing becomes inserted between the intermediate transfer belt 15 and the second transfer roller 22. Upon a voltage (second transfer bias) having a polarity that is the same as the polarity (negative) of charged toner particles being applied by the power feed roller 26, a transfer electric field is generated between the second transfer roller 22 and the backing roller 25. The unfixed toner images held on the intermediate transfer belt 15 are electrostatically transferred to the paper sheet K collectively in the second transfer section 20, which is pressurized by the second transfer roller 22 and the backing roller 25.

The paper sheet K on which the toner images have been electrostatically transferred is subsequently removed from the intermediate transfer belt 15 and immediately transported by the second transfer roller 22 to the transport belt 55, which is disposed downstream of the second transfer roller 22 in the direction in which paper sheets are transported. The transport belt 55 transports the paper sheet K to the fixing device 60 in accordance with the transportation speed optimum for the fixing device 60. The unfixed toner images present on the paper sheet K transported to the fixing device 60 are fixed to the paper sheet K by heat and pressure in the fixing device 60. The paper sheet K on which the fixed image has been formed is transported to a paper eject tray (not illustrated) disposed in an ejecting section of the image forming apparatus.

Toner particles that remain on the intermediate transfer belt 15 after the termination of the transfer to the paper sheet K are transported to the cleaning section due to the rotation of the intermediate transfer belt 15 and removed from the intermediate transfer belt 15 by the cleaning backing roller 34 and the intermediate transfer belt cleaner 35.

The exemplary embodiment is described above. It should be understood that the above-described exemplary embodiment is not restrictive, and many modifications, variations, and improvements may be made to the exemplary embodiment.

EXAMPLES

Examples of the exemplary embodiment of the present disclosure are described below. Note that, the exemplary embodiment of the present disclosure is not limited by Examples below. In the following description, "part" and "%" are all on a mass basis.

Example A1

Synthesis of Polyamic Acid

A polyamic acid DA-A1 the ends of the molecular chain of which are amino groups and a polyamic acid DC-A1 the ends of the molecular chain of which are carboxyl groups are synthesized by the following method.

Preparation of Polyamic Acid Solution DA-A1

To 800 g of N-methyl-2-pyrrolidone (hereinafter, abbreviated as "NMP"), 83.48 g (416.9 mmol) of a diamine, that is, 4,4'-diaminodiphenyl ether (hereinafter, abbreviated as "ODA"), is added. While the resulting mixture is stirred at normal temperature (25° C.), ODA is dissolved in NMP.

To the resulting solution, 116.52 g (396.0 mmol) of a tetracarboxylic dianhydride, that is, 3,3',4,4'-biphenyltetracarboxylic dianhydride (hereinafter, abbreviated as "BPDA"), is gradually added. After the addition and dissolution of the tetracarboxylic dianhydride, the temperature of the reaction solution is increased to 60° C. While the temperature of the reaction solution is maintained, a polymerization reaction is conducted for 20 hours to produce a reaction solution that includes a polyamic acid DA-A1 and NMP.

The reaction solution is filtered through a #800 stainless steel mesh, and the filtrate is cooled to room temperature (25° C.). Hereby, a polyamic acid solution DA-A1 having a viscosity of 2.0 Pa·s at 25° C. is prepared.

The viscosity of the polyamic acid solution is measured with a Type E rotational viscometer "TV-20H" produced by TOKI SANGYO CO., LTD equipped with a standard rotor (1° 34"×R24) at 25° C. and a rotational speed of 0.5 rpm (100 Pa·s or more) or 1 rpm (less than 100 Pa·s).

The viscosity of the polyamic acid solution prepared in the synthesis example below is also measured in the same manner as described above.

Preparation of Polyamic Acid Solution DC-A1

A polyamic acid solution DC-A1 that includes a polyamic acid DC-A1 and NMP and has a viscosity of 6.0 Pa·s is prepared as in the preparation of the polyamic acid solution DA-A1 described above, except that the amount of ODA used is changed to 79.57 g (397.4 mmol) and the amount of the BPDA used is changed to 120.43 g (409.3 mmol).

Preparation of Coating Liquids

Preparation of Coating Liquid A1 (Second Coating Liquid)

Polyamic acid solution DA-A1 (solid content concentration: 45 mass %): 70 parts by mass Polyamic acid solution DC-A1 (solid content concentration: 15 mass %): 30 parts by mass Acidic carbon black (dried state, conductive carbon particles) "SPECIAL BLACK 4" produced by Orion Engineered Carbons (pH: 4.5, volatile content: 18.0%, gas black (i.e., channel black), number average primary particle size: 25 nm (hereinafter, abbreviated as "SB-4")): 26 parts by mass The polyamic acid solutions DA-A1 and DC-A1 having the above-described compositions are mixed with each other. The SB-4 particles are added to the mixed polyamic acid solution and dispersed therein by performing a dispersion treatment with a ball mill at 30° C. for 12 hours. Subsequently, the mixed solution including the SB-4 particles dispersed therein is filtered through a #400 stainless steel mesh to obtain a coating liquid A1, which corresponds to the second coating liquid.

Preparation of Coating Liquid B1 (First Coating Liquid)

Polyamic acid solution DA-A1 (solid content concentration: 45 mass %): 70 parts by mass Polyamic acid solution DC-A1 (solid content concentration: 15 mass %): 30 parts by mass Acidic carbon black (dried state, conductive carbon particles) "Color Black FW200" produced by Orion Engineered Carbons (gas black (i.e., channel black), number average primary particle size: 13 nm, pH: 3.0 (hereinafter, abbreviated as "FW200")): 18 parts by mass The polyamic acid solutions DA-A1 and DC-A1 having the above-described compositions are mixed with each other. The FW-200 particles are added to the mixed polyamic acid solution and dispersed therein by performing a dispersion treatment with a ball mill at 30° C. for 12 hours. Subsequently, the mixed solution including the FW-200 particles dispersed therein is filtered through a #800 stainless steel mesh to obtain a coating liquid B1, which corresponds to the first coating liquid.

Preparation of Belt A1

Treatment of Member With Release Agent

A hollow cylindrical SUS mold having an outside diameter of 366 mm and a length of 400 mm is prepared as a member to which the coating liquid is to be applied. A silicone release agent "SEPA-COAT-SP" produced by Shin-Etsu Chemical Co., Ltd. is applied onto the outer surface of the member. The member is subsequently subjected to a drying treatment (i.e., release agent treatment).

Formation of Second Coating Film

While the cylindrical mold that has been subjected to the release agent treatment is rotated at a speed of 10 rpm in the circumferential direction, the coating liquid A1 is ejected from a dispenser having an opening size of 1.0 mm at an edge of the cylindrical mold and applied to the cylindrical mold with a metal blade disposed on the mold such that the surface of the mold is pressed at a uniform pressure. The coating liquid A1 is applied onto the surface of the cylindrical mold in a helical pattern by moving the dispenser unit in the axial direction of the cylindrical mold at a speed of 100 mm/min. Hereby, a second coating film is formed.

Drying of Second Coating Film

The mold and the second coating film are dried for 15 minutes with a drying furnace in a 140° C. air atmosphere while being rotated at 10 rpm.

After drying, as a result of the solvent being volatilized from the second coating film, the second coating film is converted into a self-supporting molded article made of a polyamic acid resin. Hereinafter, this molded article is referred to as "substrate 1".

Formation and Drying of First Coating Film

A first coating film is formed by applying the coating liquid B1 onto the outer peripheral surface of the substrate 1 by the same rotation coating method as in the application of the coating liquid A1. The first coating film is dried for 15 minutes with a drying furnace in a 140° C. air atmosphere while being rotated at 10 rpm. The integral average temperature rise rate A/B in the step of drying the first coating film is 6.00° C./min.

Baking

The substrate 1 and the first coating film are charged into an oven set to 320° C. for 4 hours. Hereby, an endless belt A1 is prepared. The overall thickness of the endless belt A1, that is, the total thickness of the substrate layer and the surface layer, is 80 μm. The thicknesses of the substrate layer and the surface layer are 26.7 μm and 53.3 μm, respectively.

The endless belt A1 is removed from the mold and hanged on a holding fixture in a tensioned state. The endless belt A1 is cut with a cutter the insertion angle of which has been adjusted. Hereby, a ring-like body having a diameter of 366 mm and a width of 369 mm is prepared. The intermediate transfer belt prepared in the above-described manner is used as a belt A1.

In the belt A1, the content of the conductive carbon particles in the entire substrate layer is 22% by mass, and the content of the conductive carbon particles in the entire surface layer is 18% by mass.

The volume resistivity of the belt A1 and the surface resistivity of the outer peripheral surface of the belt A1 are measured by the above-described methods. The common logarithm of the volume resistivity of the belt A1 is 11.5 log Ω·cm. The common logarithm of the surface resistivity of the outer peripheral surface of the belt A1 is 11.5 log Ω/suq.

Example A2

Preparation of Belt A2

An endless belt A2 is prepared as in the preparation of the endless belt A1, except that, in the step of drying the first coating film, drying is performed for 20 minutes in a 170° C. air atmosphere instead of performing drying for 15 minutes in a 140° C. air atmosphere. The overall thickness of the endless belt A2, that is, the total thickness of the substrate layer and the surface layer, is 80 μm. The thicknesses of the substrate layer and the surface layer are 26.7 μm and 53.3 μm, respectively. The integral average temperature rise rate A/B in the step of drying the first coating film is 6.5° C./min.

The endless belt A2 is cut as in the preparation of the endless belt A1. Hereby, a ring-like body having a diameter of 366 mm and a width of 369 mm is prepared. The intermediate transfer belt prepared in the above-described manner is used as a belt A2.

In the belt A2, the content of the conductive carbon particles in the entire substrate layer is 22% by mass, and the content of the conductive carbon particles in the entire surface layer is 19% by mass.

The volume resistivity of the belt A2 and the surface resistivity of the outer peripheral surface of the belt A2 are measured by the above-described methods. The common logarithm of the volume resistivity of the belt A2 is 11.8 log Ω·cm. The common logarithm of the surface resistivity of the outer peripheral surface of the belt A2 is 12.0 log Ω/suq.

Example A3

Preparation of Belt A3

An endless belt A3 is prepared as in the preparation of the endless belt A1, except that, in the step of drying the first coating film, drying is performed for 15 minutes in a 115° C. air atmosphere instead of performing drying for 15 minutes in a 140° C. air atmosphere. The overall thickness of the endless belt A3, that is, the total thickness of the substrate layer and the surface layer, is 80 μm. The thicknesses of the substrate layer and the surface layer are 26.7 μm and 53.3 μm, respectively. The integral average temperature rise rate A/B in the step of drying the first coating film is 5.74° C./min.

The endless belt A3 is cut as in the preparation of the endless belt A1. Hereby, a ring-like body having a diameter of 366 mm and a width of 369 mm is prepared. The intermediate transfer belt prepared in the above-described manner is used as a belt A3.

In the belt A3, the content of the conductive carbon particles in the entire substrate layer is 22% by mass, and the content of the conductive carbon particles in the entire surface layer is 18% by mass.

The volume resistivity of the belt A3 and the surface resistivity of the outer peripheral surface of the belt A3 are measured by the above-described methods. The common logarithm of the volume resistivity of the belt A3 is 10.8 log Ω·cm. The common logarithm of the surface resistivity of the outer peripheral surface of the belt A3 is 11.2 log Ω/suq.

Example A4

Preparation of Belt A4

An endless belt A4 is prepared as in the preparation of the endless belt A1, except that, in the step of drying the second coating film, drying is performed for 15 minutes in a 135° C. air atmosphere instead of performing drying for 15 minutes in a 140° C. air atmosphere. The overall thickness of the endless belt A4, that is, the total thickness of the substrate layer and the surface layer, is 80 μm. The thicknesses of the substrate layer and the surface layer are 26.7 μm and 53.3 μm, respectively. The integral average temperature rise rate A/B in the step of drying the first coating film is 5.9° C./min.

The endless belt A4 is cut as in the preparation of the endless belt A1. Hereby, a ring-like body having a diameter of 366 mm and a width of 369 mm is prepared. The intermediate transfer belt prepared in the above-described manner is used as a belt A4.

In the belt A4, the content of the conductive carbon particles in the entire substrate layer is 22% by mass, and the content of the conductive carbon particles in the entire surface layer is 18.2% by mass.

The volume resistivity of the belt A4 and the surface resistivity of the outer peripheral surface of the belt A4 are measured by the above-described methods. The common logarithm of the volume resistivity of the belt A4 is 11.3 log Ω·cm. The common logarithm of the surface resistivity of the outer peripheral surface of the belt A4 is 11.3 log Ω/suq.

Example B1

Preparation of Belt B1

A mold that is the same as the member used in the preparation of the endless belt A1 is prepared and subjected to the same release agent treatment as in the preparation of the endless belt A1.

A first coating film is formed by applying the coating liquid B1 onto the outer peripheral surface of the member that has been subjected to the release agent treatment by the same rotation coating method as in the application of the coating liquid A1 in the preparation of the endless belt A1. The first coating film is dried for 15 minutes with a drying furnace in a 140° C. air atmosphere while being rotated at 10 rpm. The integral average temperature rise rate A/B in the step of drying the first coating film is 6.00° C./min.

The mold and the first coating film are charged into an oven set to 320° C. for 4 hours. Hereby, an endless belt B1 is prepared. The overall thickness of the endless belt B1, that is, the thickness of the single layer, is 80 μm.

The endless belt B1 is removed from the mold and cut as in the preparation of the endless belt A1. Hereby, a ring-like body having a diameter of 366 mm and a width of 369 mm is prepared. The intermediate transfer belt prepared in the above-described manner is used as a belt B1.

The content of the conductive carbon particles in the entire belt B1 is 20% by mass.

The volume resistivity of the belt B1 and the surface resistivity of the outer peripheral surface of the belt B1 are measured by the above-described methods. The common logarithm of the volume resistivity of the belt B1 is 11.4 log Ω·cm. The common logarithm of the surface resistivity of the outer peripheral surface of the belt B1 is 11.2 log Ω/suq.

Example B2

Preparation of Belt B2

To 1000 g of a wholly aromatic polyimide varnish (solid content: 18 wt %, "U-Imide KX" produced by UNITIKA LTD., solvent: NMP), 36 g (20 phr) of first conductive carbon particles, that is, particles of oxidized gas black (channel black "FW200" produced by Orion Engineered Carbons, number average primary particle size: 13 nm), are added. With a high-pressure collision disperser produced by Geanus, the resulting mixture is passed through an orifice having a diameter of 0.1 mm at a pressure of 200 MPa and the slurries divided into two parts are brought into collision with each other. The above treatment is repeated five times to perform a dispersion treatment. Hereby, a coating liquid B2, which corresponds to the first coating liquid, is prepared.

The coating liquid B2 is applied to the outer surface of an SUS pipe having a diameter of 366 mm by flow coating to form a coating film having a predetermined thickness. The coating film is dried at 150° C. for 30 minutes while being rotated and subsequently placed in an oven heated at 320° C. for 4 hours. Hereby, an SUS pipe that includes an endless belt B2 formed on the outer surface is prepared. The overall thickness of the endless belt B2, that is, the thickness of the single layer, is 80 μm. The integral average temperature rise rate A/B in the drying step is 8.0° C./min.

The endless belt B2 covering the outer surface of the SUS pipe is removed from the SUS pipe and cut to a width of 369 mm. Hereby, a belt B2, which is a belt-like intermediate transfer body, is prepared. The content of the conductive carbon particles in the entire belt B2 is 22% by mass.

The volume resistivity of the belt B2 and the surface resistivity of the outer peripheral surface of the belt B2 are measured by the above-described methods. The common logarithm of the volume resistivity of the belt B2 is 10.1 log Ω·cm. The common logarithm of the surface resistivity of the outer peripheral surface of the belt B2 is 10.0 log Ω/suq.

Example B3

Preparation of Belt B3

An endless belt B3 is prepared as in Example B2, except that 37.8 g (21 phr) of particles of oxidized gas black (channel black "FW200" produced by Orion Engineered Carbons, number average primary particle size: 13 nm) are used as first conductive carbon particles and the collision of the slurries is performed 10 times with the high-pressure collision disperser produced by Geanus. Hereby, a belt B3, which is a belt-like intermediate transfer body, is prepared. The overall thickness of the endless belt B3, that is, the thickness of the single layer, is 80 μm. The content of the conductive carbon particles in the entire belt B3 is 21.5% by mass.

The volume resistivity of the belt B3 and the surface resistivity of the outer peripheral surface of the belt B3 are measured by the above-described methods. The common logarithm of the volume resistivity of the belt B3 is 10.0 log Ω·cm. The common logarithm of the surface resistivity of the outer peripheral surface of the belt B3 is 9.8 log Ω/suq.

Example B4

Preparation of Belt B4

An endless belt B4 is prepared as in Example B2, except that 39.6 g (22 phr) of particles of oxidized gas black (channel black "FW200" produced by Orion Engineered Carbons, number average primary particle size: 13 nm) are used as first conductive carbon particles and the collision of the slurries is performed 20 times with the high-pressure collision disperser produced by Geanus. Hereby, a belt B4, which is a belt-like intermediate transfer body, is prepared. The overall thickness of the endless belt B4, that is, the thickness of the single layer, is 80 μm. The content of the conductive carbon particles in the entire belt B4 is 22.5% by mass.

The volume resistivity of the belt B4 and the surface resistivity of the outer peripheral surface of the belt B4 are measured by the above-described methods. The common logarithm of the volume resistivity of the belt B4 is 9.8 log Ω·cm. The common logarithm of the surface resistivity of the outer peripheral surface of the belt B4 is 9.5 log Ω/suq.

Example B5

Preparation of Belt B5

An endless belt B5 is prepared as in Example B2, except that 43.2 g (24 phr) of particles of oxidized gas black (channel black "SB6" produced by Orion Engineered Carbons, number average primary particle size: 17 nm) are used as first conductive carbon particles and the collision of the slurries is performed 20 times with the high-pressure collision disperser produced by Geanus. Hereby, a belt B5, which is a belt-like intermediate transfer body, is prepared. The overall thickness of the endless belt B5, that is, the thickness of the single layer, is 80 μm. The content of the conductive carbon particles in the entire belt B5 is 24.6% by mass.

The volume resistivity of the belt B5 and the surface resistivity of the outer peripheral surface of the belt B5 are measured by the above-described methods. The common logarithm of the volume resistivity of the belt B5 is 9.9 log Ω·cm. The common logarithm of the surface resistivity of the outer peripheral surface of the belt B5 is 9.6 log Ω/suq.

Example B6

Preparation of Belt B6

Formation and Drying of First Coating Film

The solution of a precursor of polyimide (i.e., the coating liquid B1) is applied onto the outer periphery of an SUS mold having an outside diameter of 366 mm and a thickness of 10 mm by flow coating to form a first coating film having an intended thickness. The first coating film is dried by the following method.

Specifically, heating is performed at 200° C. for 24 minutes with a slit nozzle "DLX series" produced by Daico Thermotec Co., Ltd., (slit width: 0.8 mm) attached to an exhaust portion of a down-flow hot air drying furnace such that the wind velocity in the vicinity of the mold is 6 m/s. The integral average temperature rise rate A/B in the drying step is 5.74° C./min.

After drying, baking is performed at 320° C. for 4 hours. Hereby, an endless belt B6 is prepared. The overall thickness of the endless belt B6, that is, the thickness of the single layer, is 80 μm.

The endless belt B6 is removed from the mold and cut to a width of 369 mm. Hereby, a belt B6 is prepared. The content of the conductive carbon particles in the entire belt B6 is 19% by mass.

The volume resistivity of the belt B6 and the surface resistivity of the outer peripheral surface of the belt B6 are measured by the above-described methods. The common logarithm of the volume resistivity of the belt B6 is 11.5 log Ω·cm. The common logarithm of the surface resistivity of the outer peripheral surface of the belt B6 is 11.3 log Ω/suq.

Example B7

Preparation of Belt B7

An endless belt B7 is prepared as in the preparation of the endless belt B6, except that, in the drying step, heating is performed at 235° C. for 21 minutes with the slit nozzle such that the wind velocity in the vicinity of the mold is 6 m/s, instead of performing heating at 200° C. for 24 minutes with the slit nozzle. The integral average temperature rise rate A/B in the drying step is 6.84° C./min. The overall thickness of the endless belt B7, that is, the thickness of the single layer, is 80 μm.

The endless belt B7 is removed from the mold and cut to a width of 369 mm. Hereby, a belt B7 is prepared. The content of the conductive carbon particles in the entire belt B7 is 19% by mass.

The volume resistivity of the belt B7 and the surface resistivity of the outer peripheral surface of the belt B7 are measured by the above-described methods. The common logarithm of the volume resistivity of the belt B7 is 11.6 log Ω·cm. The common logarithm of the surface resistivity of the outer peripheral surface of the belt B7 is 11.4 log Ω/suq.

Example B8

Preparation of Belt B8

An endless belt B8 is prepared as in the preparation of the endless belt B6, except that, in the drying step, heating is performed at 200° C. for 16 minutes with the slit nozzle such that the wind velocity in the vicinity of the mold is 16 m/s, instead of performing heating at 200° C. for 24 minutes with the slit nozzle. The integral average temperature rise rate A/B in the drying step is 9.56° C./min. The overall thickness of the endless belt B8, that is, the thickness of the single layer, is 80 μm.

The endless belt B8 is removed from the mold and cut to a width of 369 mm. Hereby, a belt B8 is prepared. The content of the conductive carbon particles in the entire belt B8 is 19% by mass.

The volume resistivity of the belt B8 and the surface resistivity of the outer peripheral surface of the belt B8 are measured by the above-described methods. The common logarithm of the volume resistivity of the belt B8 is 11.2 log Ω·cm. The common logarithm of the surface resistivity of the outer peripheral surface of the belt B8 is 11.1 log Ω/suq.

Example C1

Preparation of Belt C1

To 1000 g of an aromatic polyamide imide varnish (solid content: 18 wt %, "HPC-9000" produced by Hitachi Chemical Company, Ltd., solvent: NMP), 37.8 g (22 phr) of first conductive carbon particles, that is, particles of oxidized gas black (channel black "FW200" produced by Orion Engineered Carbons, number average primary particle size: 13 nm), are added. With a high-pressure collision disperser produced by Geanus, the resulting mixture is passed through an orifice having a diameter of 0.1 mm at a pressure of 200 MPa and the slurries divided into two parts are brought into collision with each other. The above treatment is repeated ten times to perform a dispersion treatment. Hereby, a coating liquid C1, which corresponds to the first coating liquid, is prepared.

A mold that is the same as the member used in the preparation of the endless belt A1 is prepared and subjected to the same release agent treatment as in the preparation of the endless belt A1.

A first coating film is formed by applying the coating liquid C1 onto the outer peripheral surface of the member that has been subjected to the release agent treatment by the same rotation coating method as in the application of the coating liquid A1 in the preparation of the endless belt A1. The first coating film is dried for 15 minutes with a drying furnace in a 150° C. air atmosphere while being rotated at 10 rpm. The integral average temperature rise rate A/B in the step of drying the first coating film is 6.0° C./min.

The mold and the first coating film are charged into an oven set to 290° C. for 4 hours. Hereby, an endless belt C1 is prepared. The overall thickness of the endless belt C1, that is, the thickness of the single layer, is 80 μm.

The endless belt C1 is removed from the mold and cut as in the preparation of the endless belt A1. Hereby, a ring-like body having a diameter of 366 mm and a width of 369.5 mm is prepared. The intermediate transfer belt prepared in the above-described manner is used as a belt C1.

The content of the conductive carbon particles in the entire belt C1 is 19% by mass.

The volume resistivity of the belt C1 and the surface resistivity of the outer peripheral surface of the belt C1 are measured by the above-described methods. The common logarithm of the volume resistivity of the belt C1 is 11.2 log Ω·cm. The common logarithm of the surface resistivity of the outer peripheral surface of the belt C1 is 11.2 log Ω/suq.

Example C2

Preparation of Belt C2

To 1000 g of an aromatic polyamide imide varnish (solid content: 18 wt %, "HPC-9000" produced by Hitachi Chemical Company, Ltd., solvent: NMP), 37.8 g (22 phr) of first conductive carbon particles, that is, particles of oxidized gas black (channel black "FW200" produced by Orion Engineered Carbons, number average primary particle size: 13 nm), are added. With a high-pressure collision disperser produced by Geanus, the resulting mixture is passed through an orifice having a diameter of 0.1 mm at a pressure of 200 MPa and the slurries divided into two parts are brought into collision with each other. The above treatment is repeated ten times to perform a dispersion treatment. Hereby, a coating liquid C2, which corresponds to the first coating liquid, is prepared.

The coating liquid C2 is applied to the outer surface of an SUS pipe having a diameter of 366 mm by flow coating to form a coating film having a predetermined thickness. The coating film is dried at 150° C. for 30 minutes while being rotated and subsequently placed in an oven heated at 290° C. for 1 hour. Hereby, an SUS pipe that includes an endless belt C2 formed on the outer surface is prepared. The overall thickness of the endless belt C2, that is, the thickness of the single layer, is 80 μm. The integral average temperature rise rate A/B in the drying step is 7.2° C./min.

The endless belt C2 covering the outer surface of the SUS pipe is removed from the SUS pipe and cut to a width of 369 mm. Hereby, a belt C2, which is a belt-like intermediate transfer body, is prepared. The content of the conductive carbon particles in the entire belt C2 is 19% by mass.

The volume resistivity of the belt C2 and the surface resistivity of the outer peripheral surface of the belt C2 are measured by the above-described methods. The common logarithm of the volume resistivity of the belt C2 is 10.3 log Ω·cm. The common logarithm of the surface resistivity of the outer peripheral surface of the belt C2 is 10.2 log Ω/suq.

Example C3

Preparation of Belt C3

An endless belt C3 is prepared as in Example C2, except that 36 g (20 phr) of particles of gas black (channel black "FW1" produced by Orion Engineered Carbons, number average primary particle size: 13 nm) are used as first conductive carbon particles and the collision of the slurries is performed 20 times with the high-pressure collision disperser produced by Geanus. Hereby, a belt C3, which is a belt-like intermediate transfer body, is prepared. The overall thickness of the endless belt C3, that is, the thickness of the single layer, is 80 μm. The content of the conductive carbon particles in the entire belt C3 is 19% by mass.

The volume resistivity of the belt C3 and the surface resistivity of the outer peripheral surface of the belt C3 are measured by the above-described methods. The common logarithm of the volume resistivity of the belt C3 is 10.1 log Ω·cm. The common logarithm of the surface resistivity of the outer peripheral surface of the belt C3 is 9.9 log Ω/suq.

Example D1

Preparation of Belt D1

Pellets of a PEEK resin "450G" produced by Victrex and particles of furnace black "FW171" produced by Orion Engineered Carbons (the first conductive carbon particles, number average primary particle size: 11 nm) are charged into a Henschel mixer "FM10C" produced by Nippon Coke & Engineering Co., Ltd. such that the amount of the PEEK resin is 180 g relative to 27 g (15 phr) of the furnace black particles. The PEEK resin and the furnace black particles are mixed with each other. The resulting composition is melt-kneaded with a twin screw extruder/melt-kneader produced by Parker Corporation (L/D: 60) and subsequently extruded in the shape of a string through a hole having a diameter of 5 mm. The resulting string-like material is charged into a water tank. After the string-like material has been cooled and solidified, it is cut into a predetermined shape. Hereby, pellets of a resin mixture that includes furnace black particles are prepared.

The pellets of the resin mixture are charged into a single screw melt extruder (L/D: 24, melt extruder produced by Mitsuba Mfg Co., Ltd.) set to a predetermined temperature (380° C.) and extruded through a gap formed between a ring die and a nipple in a hollow cylindrical shape while being melted. While the extruded cylindrical film is drawn, the inner peripheral surface of the cylindrical film is brought into contact with a sizing die (i.e., a cooling mold) set to a predetermined temperature (50° C.) such that the cylindrical film is cooled, in order to fix the hollow cylindrical shape and the diameter of the film. Hereby, an endless belt D1 is prepared.

The endless belt D1 is removed from the cooling mold and hanged on a holding fixture in a tensioned state. The endless belt D1 is cut with a cutter the insertion angle of which has been adjusted. Hereby, a ring-like body having a diameter of 366 mm and a width of 369 mm is prepared. The intermediate transfer belt prepared in the above-described manner is used as a belt D1. The overall thickness of the belt D1, that is, the thickness of the single layer, is 80 μm.

The content of the conductive carbon particles in the entire belt D1 is 13% by mass.

The volume resistivity of the belt D1 and the surface resistivity of the outer peripheral surface of the belt D1 are measured by the above-described methods. The common logarithm of the volume resistivity of the belt D1 is 11.1 log Ω·cm. The common logarithm of the surface resistivity of the outer peripheral surface of the belt D1 is 11.3 log Ω/suq.

Example E1

Preparation of Belt E1

A powder of a PPS resin "TORELINA T1881" produced by Toray Industries, Inc. and particles of gas black "FW1" produced by Orion Engineered Carbons (the first conductive carbon particles, channel black, number average primary particle size: 13 nm) are charged into a Henschel mixer "FM10C" produced by Nippon Coke & Engineering Co., Ltd. such that the amount of the PPS resin is 180 g relative to 27 g (15 phr) of the gas black (i.e., channel black) particles. The PPS resin and the gas black particles are mixed with each other. The resulting composition is melt-kneaded with a twin screw extruder/melt-kneader produced by Parker Corporation (L/D: 60) and subsequently extruded in the shape of a string through a hole having a diameter of 5 mm. The resulting string-like material is charged into a water tank. After the string-like material has been cooled and solidified, it is cut into a predetermined shape. Hereby, pellets of a resin mixture that includes gas black (i.e., channel black) particles are prepared.

The pellets of the resin mixture are charged into a single screw melt extruder (L/D: 24, melt extruder produced by Mitsuba Mfg Co., Ltd.) set to a predetermined temperature (350° C.) and extruded through a gap formed between a ring die and a nipple in a hollow cylindrical shape while being melted. While the extruded cylindrical film is drawn, the inner peripheral surface of the cylindrical film is brought into contact with a sizing die (i.e., a cooling mold) set to a predetermined temperature (50° C.) such that the cylindrical film is cooled, in order to fix the hollow cylindrical shape and the diameter of the film. Hereby, an endless belt E1 is prepared.

The endless belt E1 is removed from the cooling mold and hanged on a holding fixture in a tensioned state. The endless belt E1 is cut with a cutter the insertion angle of which has been adjusted. Hereby, a ring-like body having a diameter of 366 mm and a width of 369 mm is prepared. The intermediate transfer belt prepared in the above-described manner is used as a belt E1. The overall thickness of the belt E1, that is, the thickness of the single layer, is 80 μm.

The content of the conductive carbon particles in the entire belt E1 is 13% by mass.

The volume resistivity of the belt E1 and the surface resistivity of the outer peripheral surface of the belt E1 are measured by the above-described methods. The common logarithm of the volume resistivity of the belt E1 is 10.9 log Ω·cm. The common logarithm of the surface resistivity of the outer peripheral surface of the belt E1 is 11.2 log Ω/suq.

Comparative Example F1

Preparation of Belt F1

A mold that is the same as the member used in the preparation of the endless belt A1 is prepared and subjected to the same release agent treatment as in the preparation of the endless belt A1.

A coating film is formed by applying the coating liquid A1 onto the outer peripheral surface of the member that has been subjected to the release agent treatment by the same rotation coating method as in the application of the coating liquid A1 in the preparation of the endless belt A1. The coating film is dried for 15 minutes with a drying furnace in a 140° C. air atmosphere while being rotated at 10 rpm.

The mold and the coating film are charged into an oven set to 320° C. for 4 hours. Hereby, an endless belt F1 is prepared. The overall thickness of the endless belt F1, that is, the thickness of the single layer, is 80 μm.

The endless belt F1 is removed from the mold and cut as in the preparation of the endless belt A1. Hereby, a ring-like body having a diameter of 366 mm and a width of 369.5 mm is prepared. The intermediate transfer belt prepared in the above-described manner is used as a belt F1.

The content of the conductive carbon particles in the entire belt F1 is 19% by mass.

The volume resistivity of the belt F1 and the surface resistivity of the outer peripheral surface of the belt F1 are measured by the above-described methods. The common logarithm of the volume resistivity of the belt F1 is 11.1 log Ω·cm. The common logarithm of the surface resistivity of the outer peripheral surface of the belt F1 is 11.1 log Ω/suq.

Comparative Example F2

Preparation of Belt F2

An endless belt F2 is prepared as in the preparation of the endless belt B6, except that, in the drying step, the hot air generated in the drying furnace is directly fed to the first coating film without using the slit nozzle, the wind velocity in the vicinity of the mold is changed to 0.8 m/s, and heating is performed at 200° C. for 28 minutes, instead of performing heating at 200° C. for 24 minutes with the slit nozzle. The integral average temperature rise rate A/B is 3.55° C./min. The overall thickness of the endless belt F2, that is, the thickness of the single layer, is 80 μm.

The endless belt F2 is removed from the mold and cut to a width of 369 mm. Hereby, a belt F2 is prepared. The content of the conductive carbon particles in the entire belt F2 is 19% by mass.

The volume resistivity of the belt F2 and the surface resistivity of the outer peripheral surface of the belt F2 are measured by the above-described methods. The common logarithm of the volume resistivity of the belt F2 is 11.8 log Ω·cm. The common logarithm of the surface resistivity of the outer peripheral surface of the belt F2 is 13.1 log Ω/suq.

Comparative Example F3

Preparation of Belt F3

An endless belt F3 is prepared as in the preparation of the endless belt B6, except that, in the drying step, the hot air generated in the drying furnace is directly fed to the first coating film without using the slit nozzle, the wind velocity in the vicinity of the mold is changed to 0.9 m/s, and heating is performed at 235° C. for 24 minutes, instead of performing heating at 200° C. for 24 minutes with the slit nozzle. The integral average temperature rise rate A/B is 4.36° C./min. The overall thickness of the endless belt F3, that is, the thickness of the single layer, is 80 μm.

The endless belt F3 is removed from the mold and cut to a width of 369 mm. Hereby, a belt F3 is prepared. The content of the conductive carbon particles in the entire belt F3 is 18% by mass.

The volume resistivity of the belt F3 and the surface resistivity of the outer peripheral surface of the belt F3 are measured by the above-described methods. The common logarithm of the volume resistivity of the belt F3 is 12.2 log Ω·cm. The common logarithm of the surface resistivity of the outer peripheral surface of the belt F3 is 12.8 log Ω/suq.

Measurement of Endless Belts

The L(r) integral and potential attenuation rate [V/msec] of each of the endless belts prepared in Examples and Comparative examples above are determined by the above-described methods. Table 1 summarizes the results.

Table 1 also summarizes the layer structure of each of the endless belts, the type of the resin included in the single layer or first layer of the endless belt, and the number average primary particle size of the conductive carbon particles included in the single layer or first layer.

Evaluation of Endless Belts (1)

Evaluation of Transferability to Rough Surface Paper (1)

A specific one of the transfer belts is attached to a modification of image forming apparatus "DocuColor-7171P" (specifically, a modification prepared by attaching the transfer belt to the image forming apparatus and adjusting the cleaning blade in accordance with the thickness of the belt). In an environment of 22° C. and 55 RH %, under the condition where the speed at which a recording medium is transported through the second transfer region is 308 mm/s, a solid blue image is formed on a rough surface paper "LEATHAC 66" (204 gsm). Then, the white missing dots formed in the recesses of the surface of the paper are visually inspected. The evaluation standards are as follows. Table 1 summarizes the results.

The conductive roller (1) described below is used in the evaluation as a first transfer roller.

A toner having a volume average particle size of 4.7 μm is used in the evaluation.

A: No white missing dots occur
B: Slight color change occurs
C: Clear color change occurs
D: White missing dots occur Preparation of Conductive Roller (1)

Epichlorohydrin-allyl glycidyl ether copolymer (ECO) "Zecron 1100" produced by Zeon Corporation: 40 parts by mass Acrylonitrile-butadiene rubber (NBR) "Nipol DN223" produced by Zeon Corporation: 60 parts by mass Foaming agent (benzenesulfonyl hydrazide): 6 parts by mass Vulcanizing agent "Sulfur" produced by Tsurumi Chemical Industry Co., Ltd., 200 mesh) 1 part by mass Vulcanization accelerator "NOCCELER M" produced by Ouchi Shinko Chemical Industrial Co., Ltd.: 1.5 parts by mass A rubber composition including the above components is kneaded with an open roller. The kneaded rubber composition is extruded in a shape having a through-hole at the center, that is, in a doughnut shape, to form a hollow cylindrical roller. The hollow cylindrical roller is vulcanized and foamed by heating at 160° C. for 20 minutes. Hereby, a conductive roller (1) is prepared.

TABLE 1

| | Belt | Layer structure | Resin | Primary particle size (nm) | L(r) integral | Potential attenuation rate (V/msec) | Transfer evaluation (1) |
|---|---|---|---|---|---|---|---|
| Example A1 | A1 | Multilayer | PI | 13 | 0.07 | 3.0 | A |
| Example A2 | A2 | Multilayer | PI | 13 | 0.06 | 2.3 | B |
| Example A3 | A3 | Multilayer | PI | 13 | 0.08 | 3.8 | B |
| Example A4 | A4 | Multilayer | PI | 13 | 0.05 | 2.9 | A |
| Example B1 | B1 | Single layer | PI | 13 | 0.05 | 2.9 | A |
| Example B2 | B2 | Single layer | PI | 13 | 0.06 | 4.1 | A |
| Example B3 | B3 | Single layer | PI | 13 | 0.04 | 4.3 | A |
| Example B4 | B4 | Single layer | PI | 13 | 0.03 | 3.8 | A |
| Example B5 | B5 | Single layer | PI | 17 | 0.09 | 3.2 | B |
| Example B6 | B6 | Single layer | PI | 13 | 0.09 | 3.2 | B |
| Example B7 | B7 | Single layer | PI | 13 | 0.07 | 3.4 | B |
| Example B8 | B8 | Single layer | PI | 13 | 0.05 | 3.6 | B |
| Example C1 | C1 | Single layer | PAI | 13 | 0.10 | 5.2 | A |
| Example C2 | C2 | Single layer | PAI | 13 | 0.05 | 5.3 | A |
| Example C3 | C3 | Single layer | PAI | 13 | 0.07 | 5.5 | A |
| Example D1 | D1 | Single layer | PEEK | 11 | 0.10 | 2.9 | B |
| Example E1 | E1 | Single layer | PPS | 13 | 0.09 | 3.4 | A |
| Comparative example F1 | F1 | Single layer | PI | 25 | 0.90 | 1.9 | D |
| Comparative example F2 | F2 | Single layer | PI | 13 | 0.15 | 2.1 | D |
| Comparative example F3 | F3 | Single layer | PI | 13 | 0.11 | 2.2 | D |

Evaluation of Endless Belts (2)

Evaluation of Transferability to Rough Surface Paper (2)

A specific one of the transfer belts is attached to a modification of image forming apparatus "DocuColor-7171P" (specifically, a modification prepared by attaching the transfer belt to the image forming apparatus and adjusting the cleaning blade in accordance with the thickness of the belt). A corresponding one of the conductive rollers described in Table 2 is used as a first transfer roller. In an environment of 22° C. and 55 RH % (in Table 2, referred to as "normal environment") or an environment of 10° C. and 15 RH % (in Table 2, referred to as "low temperature, low humidity environment"), under the condition where the speed at which a recording medium is transported through the second transfer region is 308 mm/s, a solid blue image is formed on a rough surface paper "LEATHAC 66" (204 gsm). Then, the white missing dots formed in the recesses of the surface of the paper are visually inspected. The evaluation standards are as follows. Table 2 summarizes the results.

A toner having a volume average particle size of 4.7 μm is used in the evaluation.

A: No white missing dots occur
B+: Trace color change occurs
B: Slight color change occurs
C: Clear color change occurs
D: White missing dots occur Evaluation of Discharge Defects A specific one of the transfer belts is attached to a modification of image forming apparatus "DocuColor-7171P" (specifically, a modification prepared by attaching the transfer belt to the image forming apparatus and adjusting the cleaning blade in accordance with the thickness of the belt). A corresponding one of the conductive rollers described in Table 2 is used as a first transfer roller. In an environment of 28° C. and 85 RH % (in Table 2, referred to as "high temperature, high humidity environment"), a black halftone 50% image is formed on a wood free paper sheet (84 gsm). The evaluation of discharge defects is conducted by visually inspecting the number of white dots formed in the image. The evaluation standards are as follows. Table 2 summarizes the results.

A: No white dots occur on the image
B: A few white dots occur on the image
C: Plural white dots occur locally on the image
D: Plural white dots occur all over the image. The conductive rollers (1) to (3) described in Table 2 are prepared in the following manner.

Preparation of Conductive Roller (1)

Epichlorohydrin-allyl glycidyl ether copolymer (ECO) "Zecron 1100" produced by Zeon Corporation: 40 parts by mass Acrylonitrile-butadiene rubber (NBR) "Nipol DN223" produced by Zeon Corporation: 60 parts by mass Foaming agent (benzenesulfonyl hydrazide): 6 parts by mass Vulcanizing agent "Sulfur" produced by Tsurumi Chemical Industry Co., Ltd., 200 mesh) 1 part by mass Vulcanization accelerator "NOCCELER M" produced by Ouchi Shinko Chemical Industrial Co., Ltd.: 1.5 parts by mass A rubber composition including the above components is kneaded with an open roller. The kneaded rubber composition is extruded in a shape having a through-hole at the center, that is, in a doughnut shape, to form a hollow cylindrical roller. The hollow cylindrical roller is vulcanized and foamed by heating at 160° C. for 20 minutes. Hereby, a conductive roller (1) is prepared.

Preparation of Conductive Roller (2)

Epichlorohydrin-allyl glycidyl ether copolymer (ECO) "Zecron 1100" produced by Zeon Corporation: 40 parts by mass Acrylonitrile-butadiene rubber (NBR) "Nipol DN223" produced by Zeon Corporation: 60 parts by mass Carbon black 1 ("Particulate Acetylene Black" produced by Denka Company Limited): 10 parts by mass Carbon black 2 ("Asahi Thermal FT" produced by Asahi Carbon Co., Ltd.): 50 parts by mass Foaming agent (benzenesulfonyl hydrazide): 6 parts by mass Vulcanizing agent "Sulfur" produced by Tsurumi Chemical Industry Co., Ltd., 200 mesh) 1 part by mass Vulcanization accelerator "NOCCELER M" produced by Ouchi Shinko Chemical Industrial Co., Ltd.: 1.5 parts by mass A rubber composition including the above components is kneaded with an open roller. The kneaded rubber composition is extruded in a shape having a through-hole at the center, that is, in a doughnut shape, to form a hollow cylindrical roller. The hollow cylindrical roller is vulcanized and foamed by heating at 160° C. for 20 minutes. Hereby, a conductive roller (2) is prepared.

Preparation of Conductive Roller (3)

A conductive roller (3) is prepared as in the preparation of the conductive roller (2), except that the temperature at which vulcanization and foaming are performed is changed from 160° C. to 140° C.

In Table 2, the term "Initial resistance" refers to the initial resistance measured at 22° C. and 55 RH %; "Environmental resistance variation" is the value determined by the above-described method; the term "Resistance in low temperature low humidity environment" refers to the resistance measured at 10° C. and 15 RH %; and the term "Resistance in high temperature high humidity environment" refers to the resistance measured at 28° C. and 85 RH %.

The term "Voltage source capacity" refers to the maximum capacity of a voltage source that feeds electric power to the conductive roller.

TABLE 2

| | | Example B2-1 | Example B2-2 | Example B2-3 | Comparative example F1-1 | Comparative example F1-2 |
|---|---|---|---|---|---|---|
| Intermediate transfer belt | Type | B2 | B2 | B2 | F1 | F1 |
| | L(r) integral | 0.06 | 0.06 | 0.06 | 0.90 | 0.90 |
| Conductive roller | Type | (1) | (2) | (3) | (3) | (1) |
| | Initial resistance (logΩ) | 7.7 | 7.7 | 8.0 | 8.0 | 7.7 |
| | Environmental resistance variation (logΩ) | 1.5 | 0.2 | 0.3 | 0.3 | 1.5 |
| | Resistance in low temperature low humidity environment (logΩ) | 8.2 | 7.7 | 8.0 | 8.0 | 8.2 |
| | Resistance in high temperature high humidity environment (logΩ) | 6.7 | 7.5 | 7.7 | 7.7 | 6.7 |
| | Voltage source capacity(kV) | 8.0 | 8.0 | 8.0 | 8.0 | 8.0 |
| Evaluations | Transfer evaluation (2) in normal environment | A | A | A | D | D |
| | Transfer evaluation (2) in low temperature low humidity environment | B | B+ | A | D | D |
| | Discharge defects in high temperature high humidity environment | D | B | A | A | D |

The results described in Tables 1 and 2 confirm that the belts prepared in Examples above are excellent in terms of transferability even when a recording medium having large surface irregularities is used, compared with the belts prepared in Comparative examples above.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An endless belt comprising:

a first resin; and first conductive carbon particles, wherein, in a spatial distribution of the first conductive carbon particles present in an evaluation region of an outer peripheral surface of the endless belt, the evaluation region having a size of 6.3 μm×4.2 μm, an integral of a statistic L(r) represented by Formula (1) below from 0.05 μm to 0.30 μm with respect to an interparticle distance r is 0 or more and 0.1 or less, $$L(r):=\sqrt{K(r)/\pi}-r \tag{1}$$

where r represents the interparticle distance; and K(r) represents a Ripley's K function K(r) represented by Formula (2) below, $$K(r):=\frac{\sum_{i\neq j}^{N} 1(|X_i-X_j|\leq r)/s(|X_i-X_j|)}{\lambda^2} \tag{2}$$

where $1(|X_i-X_j|\leq r)$ represents an indicator function; $X_i$ and $X_j$ represent coordinates of points i and j, respectively; $|X_i-X_j|$ represents an Euclidean distance between the coordinates $X_i$ and $X_j$; r represents the interparticle distance; $s(|X_i-X_j|)$ represents an edge correction factor s(x) in the evaluation region, the edge correction factor s(x) being represented by Formula (3) below, x being $|X_i-X_j|$; N represents a total number of particles present in the evaluation region; and λ represents a number density of the particles in the evaluation region, $$s(x) := L_x L_y - \frac{x}{\pi}(2L_x + 2L_y - x) \quad (3)$$

where $L_x$ and $L_y$ represent the lengths [μm] of sides of the evaluation region which extend in x axis and y axis directions, respectively; $x=|X_i-X_j|$; $X_i$ and $X_j$ represent coordinates of points i and j, respectively; and $|X_i-X_j|$ represents a Euclidean distance between the coordinates $X_i$ and $X_j$.

2. The endless belt according to claim 1, wherein the first resin includes at least one selected from the group consisting of a polyimide resin, a polyamide imide resin, an aromatic polyether ether ketone resin, a polyphenylene sulfide resin, and a polyetherimide resin.

3. The endless belt according to claim 2, wherein the first resin includes a polyimide resin.

4. The endless belt according to claim 1, wherein a potential attenuation rate dV/dt measured after the outer peripheral surface of the endless belt is charged to +500 V is 2.0 V/msec or more and 6.0 V/msec or less.

5. The endless belt according to claim 1, further comprising:

a substrate layer; and a surface layer disposed on the substrate layer, the surface layer including the first resin and the first conductive carbon particles.

6. The endless belt according to claim 5, wherein the substrate layer includes a second resin and second conductive carbon particles; and wherein the first conductive carbon particles have a smaller number average primary particle size than the second conductive carbon particles.

7. The endless belt according to claim 1, wherein a number average primary particle size of the first conductive carbon particles is 10 nm or more and 20 nm or less.

8. The endless belt according to claim 1, wherein the first resin includes at least one selected from the group consisting of a polyimide resin and a polyamide imide resin; and wherein the first conductive carbon particles include channel black particles.

9. The endless belt according to claim 1, wherein the first resin includes at least one selected from the group consisting of an aromatic polyether ether ketone resin, a polyphenylene sulfide resin, and a polyetherimide resin; and wherein the first conductive carbon particles include at least one selected from the group consisting of channel black particles and furnace black particles.

10. A transfer device comprising:

an intermediate transfer body that is the endless belt according to claim 1;

a first transfer unit that transfers a toner image formed on a surface of an image holding member onto a surface of the intermediate transfer body as first transfer; and a second transfer unit that transfers the toner image transferred on the surface of the intermediate transfer body onto a surface of a recording medium as second transfer.

11. The transfer device according to claim 10, wherein the first transfer unit includes a conductive roller including an elastic foam layer, the elastic foam layer being an outermost layer; and wherein a difference [log Ω] between a common logarithm of a resistance value of the elastic foam layer at 28° C. and 85 RH % and a common logarithm of a resistance value of the elastic foam layer at 10° C. and 15 RH % is 0.1 log Ω or more and 0.6 log Ω or less.

12. The transfer device according to claim 11, wherein the elastic foam layer includes an epichlorohydrin rubber and an electron-conductive conductant agent.

13. An image forming apparatus comprising:

an image holding member;

a charging device that charges a surface of the image holding member;

an electrostatic latent image forming device that forms an electrostatic latent image on the surface of the image holding member;

a developing device that includes a developer including a toner and develops the electrostatic latent image formed on the surface of the image holding member with the developer to form a toner image; and a transfer device that transfers the toner image onto a surface of a recording medium, the transfer device being the transfer device according to claim 10.

14. The image forming apparatus according to claim 13, wherein the toner has a volume average particle size of 2 μm or more and 5 μm or less.

15. A method for producing an endless belt, the method comprising:

preparing a coating liquid that includes a first resin or a precursor of the first resin, first conductive carbon particles, and a solvent;

applying the coating liquid onto an outer periphery of a member to form a coating film; and drying the coating film while increasing a temperature of the member, wherein an integral average temperature rise rate A/B [° C./min] is 5.74° C./min or more, where A [° C.] is an integral average of a temperature of the member over the drying, and B [min] is the amount of time it takes for the temperature of the member to reach the integral average A [° C.] after the drying is started.

16. The method for producing an endless belt according to claim 15, wherein, in the drying, hot air having a temperature of 110° C. or more and 235° C. or less is fed to the coating film in order to dry the coating film.

17. The method for producing an endless belt according to claim 16, wherein a velocity of the hot air on a surface of the coating film is 1 m/s or more and 20 m/s or less.

18. The method for producing an endless belt according to claim 16, wherein the hot air is blown through a slit nozzle against a surface of the coating film in order to feed the hot air to the coating film.

19. The method for producing an endless belt according to claim 15, the method further comprising:

baking the coating film dried in the drying.

20. The method for producing an endless belt according to claim 15, wherein the endless belt according to claim 1 is produced.

* * * * *